US011179591B1

(12) United States Patent
Bazargan et al.

(10) Patent No.: US 11,179,591 B1
(45) **Date of Patent: *Nov. 23, 2021**

(54) ADJUSTABLE RESISTANCE WEIGHT SLED WITH BIAS CORRECTION, WHEEL SKID CONTROL, AND OMNI-DIRECTIONAL MOTION

(71) Applicants: Sahm Bazargan, Simi Valley, CA (US); Alexander Y. Kim, Valencia, CA (US); David George Eastham, Jr., Canyon Country, CA (US); Brian S. Boon, Gig Harbor, WA (US)

(72) Inventors: Sahm Bazargan, Simi Valley, CA (US); Alexander Y. Kim, Valencia, CA (US); David George Eastham, Jr., Canyon Country, CA (US); Brian S. Boon, Gig Harbor, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/953,963

(22) Filed: Nov. 20, 2020

Related U.S. Application Data

(63) Continuation-in-part of application No. 16/919,544, filed on Jul. 2, 2020, now Pat. No. 10,874,897.

(60) Provisional application No. 63/056,813, filed on Jul. 27, 2020.

(51) Int. Cl.

| | |
|---|---|
| ***A63B 21/06*** | (2006.01) |
| ***A63B 22/20*** | (2006.01) |
| ***A63B 21/00*** | (2006.01) |
| ***A63B 21/005*** | (2006.01) |

(52) U.S. Cl.
CPC ..... *A63B 21/0618* (2013.01); *A63B 21/0056* (2013.01); *A63B 21/0058* (2013.01); *A63B 21/4034* (2015.10); *A63B 22/20* (2013.01)

(58) Field of Classification Search
CPC . A63B 21/0618; A63B 22/20; A63B 21/0058; A63B 21/4034
See application file for complete search history.

(56) References Cited

U.S. PATENT DOCUMENTS

| | | | | |
|---|---|---|---|---|
| 4,451,037 | A | 5/1984 | O'Hare | |
| 5,810,697 | A * | 9/1998 | Joiner | A63B 21/06 280/47.371 |
| 6,761,650 | B1 * | 7/2004 | Dettmann | A63B 69/345 473/441 |

(Continued)

*Primary Examiner* — Jennifer Robertson
*Assistant Examiner* — Catrina A Letterman
(74) *Attorney, Agent, or Firm* — Galvin Patent Law LLC; Brian R. Galvin; Brian S. Boon

(57) ABSTRACT

A weight sled that allows both linear and non-linear movements such that resistance training can be performed in the frontal, sagittal, and combined frontal/sagittal planes, and which allows easy movement for transportation, storage, and retrieval from storage. The weight sled uses one or more swiveling, pivoting, or omni-directional wheels that allow all or a portion of the sled to be moved laterally. The addition of wheel configurations allowing of lateral movement of all of, or a portion of, the weight sled greatly expands the utility of weight sleds because movement in any direction can be trained, whether in the sagittal body plane (forward/backward movements), the frontal body plane (lateral movements), or a combination of the two. Additionally, the plurality of wheel configurations allows for a variety of storage arrangements.

17 Claims, 33 Drawing Sheets

(56) References Cited

U.S. PATENT DOCUMENTS

| | | | | |
|---|---|---|---|---|
| 8,469,861 | B1 * | 6/2013 | McFee | A63B 21/0059 482/5 |
| 9,834,242 | B2 * | 12/2017 | Wang | B62B 5/0036 |
| 10,398,926 | B2 * | 9/2019 | Baumler | A63B 21/0056 |
| 10,398,927 | B2 | 9/2019 | Baumler | |
| 2001/0038185 | A1 * | 11/2001 | DeNoble | B60P 3/40 280/79.11 |
| 2007/0105694 | A1 * | 5/2007 | Panatta | A63B 22/0605 482/57 |
| 2012/0214652 | A1 * | 8/2012 | Williams | A63B 23/03541 482/132 |
| 2014/0035246 | A1 * | 2/2014 | Plotnizky | A61G 5/047 280/87.01 |
| 2020/0238127 | A1 * | 7/2020 | Wehrell | A63B 21/4034 |

* cited by examiner

ADJUSTABLE RESISTANCE WEIGHT SLED WITH BIAS CORRECTION, WHEEL SKID CONTROL, AND OMNI-DIRECTIONAL MOTION

CROSS-REFERENCE TO RELATED APPLICATIONS

CROSS-REFERENCE TO RELATED APPLICATIONS

| Application No. | Date Filed | Title |
|---|---|---|
| Current application | Herewith | ADJUSTABLE RESISTANCE WEIGHT SLED WITH BIAS CORRECTION, WHEEL SKID CONTROL, AND OMNI-DIRECTIONAL MOTION |
| | | which claims benefit of; and priority to: |
| 63/056,813 | Jul. 27, 2020 | ADJUSTABLE RESISTANCE WEIGHT SLED WITH BIAS CORRECTION, WHEEL SKID CONTROL, AND OMNI-DIRECTIONAL MOTION |
| | | and is also a continuation-in-part of: |
| 16/919,544 | Jul. 2, 2020 | ADJUSTABLE RESISTANCE WEIGHT SLED WITH BIAS CORRECTION AND WHEEL SKID CONTROL |

the entire specification of each of which is incorporated herein by reference.

BACKGROUND

Field of the Art

The disclosure relates to the field of fitness devices, and more particularly to the field of weight sleds for fitness training.

Discussion of the State of the Art

Weight sleds, or weight training sleds, are used in various sports to increase the speed and power of an athlete's driving force. Most such sleds are designed to hold iron or steel weight discs to provide a downward force and inertial resistance. Weight sleds with fixed skis or runners use the force of friction against the ground as the primary resistive force. Other weight sleds use wheels and some form of mechanical or electro-mechanical resistance as the primary resistive force. Regardless of type, however, existing weight sleds are designed for push and pull motions only in a linear, sagittal direction and do not allow for training frontal or combined planes of motions. Further, their fixed sleds or wheel positions make transportation, storage, and retrieval from storage difficult.

What is needed is needed is a weight sled that allows both linear and non-linear movements such that resistance training can be performed in the frontal, sagittal, and combined frontal/sagittal planes, and which allows easy movement for transportation, storage, and retrieval from storage.

SUMMARY

Accordingly, the inventor has conceived and reduced to practice, a weight sled that allows both linear and non-linear movements such that resistance training can be performed in the frontal, sagittal, and combined frontal/sagittal planes, and which allows easy movement for transportation, storage, and retrieval from storage. The weight sled uses one or more swiveling, pivoting, or omni-directional wheels that allow all or a portion of the sled to be moved laterally. The addition of wheel configurations allowing of lateral movement of all of, or a portion of, the weight sled greatly expands the utility of weight sleds because movement in any direction can be trained, whether in the sagittal body plane (forward/backward movements), the frontal body plane (lateral movements), or a combination of the two. Weight sleds have heretofore been designed for linear motion in a sagittal direction (i.e., forward/backward pushing or pulling motions). The omni-directional weight sled allows the user to train dynamically in both sagittal and frontal planes simultaneously. This more closely mimics the mobility required in many sports such as football, soccer, hockey, etc. An example workout with this device could be a slalom which trains the users power and mobility as they weave through cones. Some embodiments allow limited vertical motion of wheels via a spherical four-bar linkage. Additionally, the plurality of wheel configurations allows for a variety of storage arrangements.

According to a preferred embodiment, an omni-directional weight sled is disclosed, comprising: a chassis constructed of rigid materials; and a plurality of wheels attached to the chassis, wherein at least one of the plurality of wheels is capable of swiveling or pivoting.

According to an aspect of an embodiment, the at least one of the one or more of the plurality of wheels capable of swiveling or pivoting is a caster wheel.

According to an aspect of an embodiment, the caster wheel comprises an internal motor.

According to an aspect of an embodiment, the motor is fully or partially shorted to provide a variable resistance.

According to an aspect of an embodiment, the at least one of the one or more of the plurality of wheels capable of swiveling or pivoting is detachable or retractable.

According to an aspect of an embodiment, the at least one of the one or more of the plurality of wheels capable of swiveling or pivoting is affixed by a slide-lock mechanism.

According to an aspect of an embodiment, the at least one of the one or more of the plurality of wheels capable of swiveling or pivoting is affixed by a locking pin mechanism.

According to an aspect of an embodiment, the at least one of the one or more of the plurality of wheels capable of swiveling or pivoting is retractable by a foot pedal mechanism.

According to an aspect of an embodiment, the device further comprises at least two wheels capable of swiveling or pivoting, and the at least two wheels capable of swiveling or pivoting are connected via a four-bar linkage.

According to an aspect of an embodiment, the four-bar linkage is a spherical four-bar linkage that pivots about a central point allowing vertical motion of the wheels.

According to an aspect of an embodiment, at least one of the plurality of wheels is not capable of swiveling or pivoting, and a resistance mechanism is mechanically connected to the at least one of the plurality of wheels is not capable of swiveling or pivoting.

According to another preferred embodiment, an omni-directional weight sled is disclosed, comprising: a chassis constructed of rigid materials; and a plurality of wheels attached to the chassis, wherein at least one of the plurality of wheels is an omni-directional wheel.

According to an aspect of an embodiment, the omni-directional wheel is an omni-wheel, comprising rollers mounted around the circumference of a wheel, the axles of the rollers being perpendicular to the axle of the wheel.

According to an aspect of an embodiment, the omni-directional wheel is a ball bearing caster.

According to an aspect of an embodiment, the omni-directional wheel is detachable or retractable.

According to an aspect of an embodiment, the omni-directional wheel is affixed by a slide-lock mechanism.

According to an aspect of an embodiment, the omni-directional wheel is affixed by a locking pin mechanism.

According to an aspect of an embodiment, the omni-directional wheel is retracted by a foot pedal mechanism.

According to an aspect of an embodiment, at least one of the plurality of wheels is not an omni-directional wheel, and a resistance mechanism is mechanically connected to the at least one of the plurality of wheels that is not an omni-directional wheel.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Figure 1:
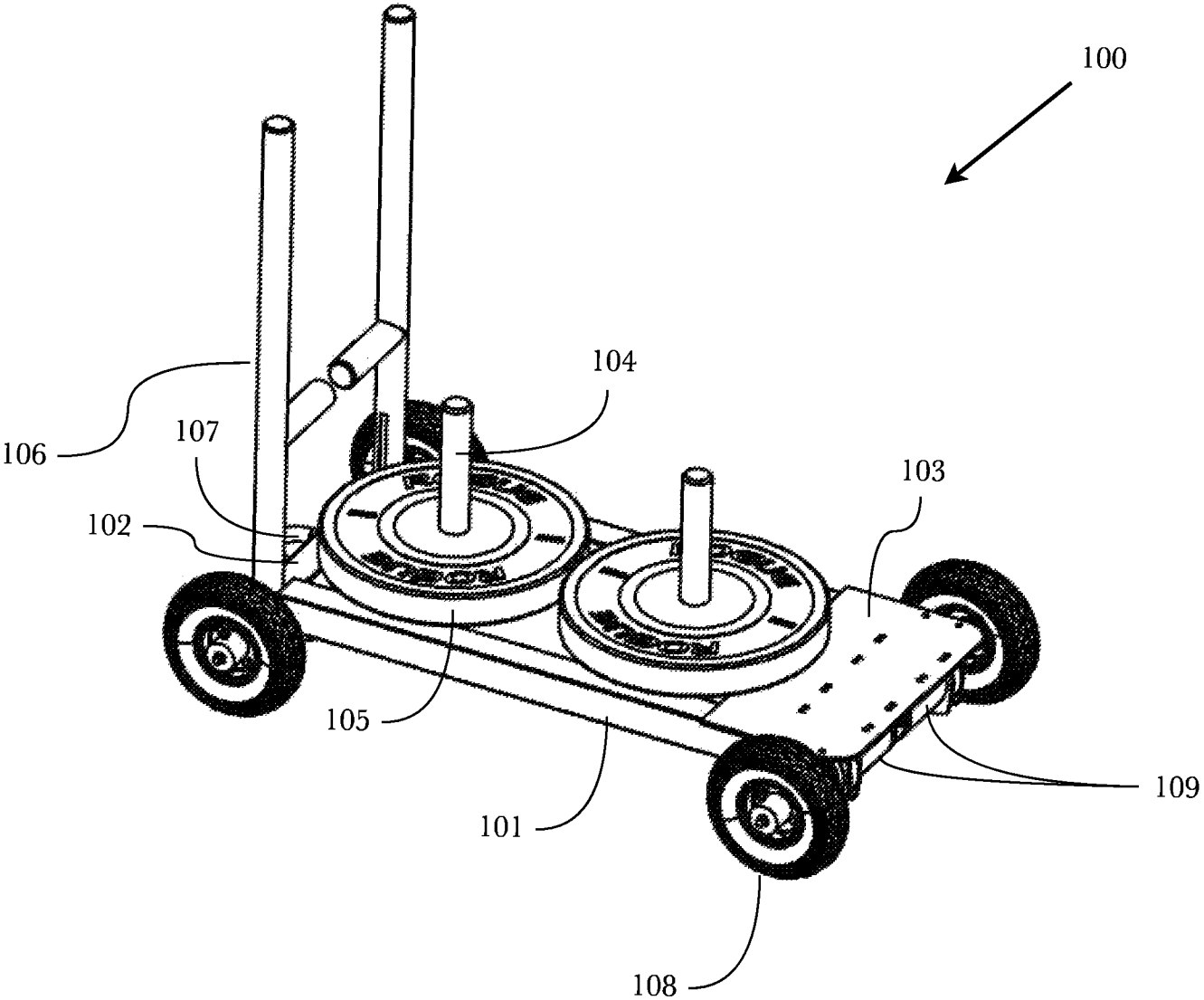
FIG. 1 is an orthogonal view of an exemplary multi-mechanism bias-correctable adjustable resistance weight sled.

The inventor has conceived and reduced to practice, a weight sled that allows both linear and non-linear movements such that resistance training can be performed in the frontal, sagittal, and combined frontal/sagittal planes, and which allows easy movement for transportation, storage, and retrieval from storage. The weight sled uses one or more swiveling, pivoting, or omni-directional wheels that allow all or a portion of the sled to be moved laterally. The addition of wheel configurations allowing of lateral movement of all of, or a portion of, the weight sled greatly expands the utility of weight sleds because movement in any direction can be trained, whether in the sagittal body plane (forward/backward movements), the frontal body plane (lateral movements), or a combination of the two. Weight sleds have heretofore been designed for linear motion in a sagittal direction (i.e., forward/backward pushing or pulling motions). The omni-directional weight sled allows the user to train dynamically in both sagittal and frontal planes simultaneously. This more closely mimics the mobility required in many sports such as football, soccer, hockey, etc. An example workout with this device could be a slalom which trains the users power and mobility as they weave through cones.

Some embodiments include four-bar linkages and other variants which may be implemented to allow for vertical movement of wheels allowing traversal of uneven terrain or curved surfaces. Additionally, the plurality of wheel configurations allows for a variety of storage arrangements.

As many fitness clubs have limited space, another benefit to an omni-directional weight sled is the ability to maneuver the sled in tight confines. This enables the sled to be used in smaller areas, to be turned around at the end of a narrow path or track, and allows for easy transport, storage, and retrieval from storage, especially in tight storage spaces.

As weighted sleds are heavy, the straight sleds and wheels of existing sled make it difficult to maneuver them around gyms and can require heavy lifting and/or multiple people to move them, the addition of pivoting or lateral movement allows the user to easily move the weight sled without risking injury. This will also allow coaches, trainers, gym owners, managers, and staff to store and manage a larger number of sleds with less effort, even where such individuals are not athletes or have physical limitations. Other embodiments disclosed allow for vertical adjustment of the weight sled which assists in storage but also allows for the weight sled to traverse uneven terrain and curved surfaces.

In some embodiments, the weight sled will have four wheels and two electric motors, with one of the electric motors being mounted to the left front wheel and the other being mounted to the right front wheel. The motor leads (positive and negative electrical connectors that through which electrical power would normally be provided to make the motor operate) are electrically connected to one another, providing some degree of shorting (i.e., some degree of electrical conductivity) between the leads of the electrical motor. Shorting the leads of an electrical motor causes the motor to generate an electromagnetic field as the rotor shaft is turned, causing electromagnetic resistance which resists the turning of the rotor shaft. The amount of resistance generated against the rotation of the shaft is a proportional function of the speed of shaft rotation and the degree of shorting between the leads of the motor. The degree of shorting can be controlled by electromechanical means such as a potentiometer which varies the resistance (which, by definition, varies the conductivity in an inverse relationship), or using pulse width modulation of a transistor or transistor-containing integrated circuit chip which rapidly shorts and disconnects the connection between the leads, with the amount of on/off time being adjustable. Both methods allow adjustment of the resistance produced by the motor through the entire range from a full electrical short (i.e., little or no electrical resistance between the motor leads) to a minimal electrical short (i.e., a very high electrical resistance or no connection between the motor leads). The greater the degree of shorting, the greater the electromagnetic resistance generated when the motor shaft is rotated. Thus, very fine control over the resistance can be obtained by adjusting the degree of shorting using resistance or the timing of on/off cycles.

Having motors mounted to opposite sides of the weight sled allows for variable forces to be generated by each of the motors. For example, where the motors are subject to a fixed degree of shorting, pushing the sled in a non-linear motion (i.e., applying some amount of force laterally to the forward direction) will cause the front wheel on the side of the sled in the direction of the lateral force to rotate faster, causing more resistance in that front wheel, tending to automatically correct lateral movement of the sled. For example, if, during training, the athlete inadvertently pushes the sled in a counter-clockwise motion (as viewed from above the weight sled), the right front wheel will be moving in a larger arc than the left front wheel. The right front wheel will, therefore, be rotating faster than the left front wheel, and will thus generate more resistance. This additional resistance on the right from wheel will counter some of the lateral force being exerted to the right, and will tend to straighten out the movement of the sled. This characteristic can also be used intentionally, if the athlete wants to practice using some lateral force while driving the sled forward during training.

Because there are two (or more) motors, and a separate degree of shorting can be used for each, the weight sled can be adjusted to increase or reduce bias in the direction of the weight sled during use. For example, if the ground surface is artificial grass that has a leftward directional bias when pushing the weight sled in a certain direction (i.e., the weave, or grain, of the artificial grass tends to push the wheels of the weight sled left when moving along the artificial grass in a certain direction), the resistance of the left front wheel of the weight sled can be reduced (or the resistance of the right front wheel can be increased, or both) to counter the bias of the artificial grass and keep the weight sled moving straight. This characteristic can also be used to intentionally induce a bias in the direction of motion of the weight sled, forcing the athlete to apply some lateral force to keep the weight sled moving in a straight line.

Further, the separately-adjustable nature of the two (or more) motors can be used to reduce or prevent wheel skid by monitoring the rotation speed of each wheel to which a resistance mechanism is attached, and adjusting the degree of shorting accordingly. Where one wheel's rotation speed suddenly drops in relation to another wheel, the degree of shorting of the resistance mechanism of the slowed wheel can be immediately reduced to decrease the resistance on that wheel, thus reducing or preventing wheel skid, and then increased again as the wheel comes back up to the expected rotation speed. The wheels can be continuously monitored to increase or decrease resistance as necessary to maximize traction and resistance while reducing wheel skid.

While the descriptions herein typically describe the use of motors as the resistance mechanisms, other devices can be used. In some embodiments, instead of an electric motor, an eddy current brake can be used, which also provides increasing resistance through electromagnetic force. Eddy current brakes are also referred to as induction brakes, electric brakes, or electric retarders, and in the rotating version comprise a disc made of non-ferrous material, a portion of which passes through stationary poles of a magnet (the north pole of the magnet on one side of the disc and the south pole on the other. As the speed of rotation of the disc increases, the magnet exerts a drag force on the non-ferrous metal which opposes the disc's rotation due to circular electric currents called eddy currents (magnetic flux currents) induced in the metal by the magnetic field. The amount of resistance provided by the eddy current brake is proportional to the speed of rotation of the disc. Eddy current disc brakes are of two types: permanent magnet and electromagnet. In the permanent magnet version, the magnet is a permanent magnet, and may be moveable to adjust the amount of the disc covered by the magnets. In the electromagnetic version, the magnet is an electromagnet, and the amount of current through the electromagnet may be adjusted (e.g., by a potentiometer) to vary the magnetic field, and hence, the eddy current resistance induced in the disc.

There are also non-electromagnetic mechanisms that can be used as the resistance mechanisms. For example, air fans and water-filled containers provide exponentially-increasing resistance as a function of speed. Air fans, for example, can be engaged with the wheels of the weight sled via gears, belts, or chains, such that the air fan spins as the wheel turns. Air fans are designed for forced movement of air and come in various configurations, including propellers, windmills, and so-called "squirrel cage" blowers. The ratio of wheel speed to fan speed can be adjusted by changing the size of the gears, belt pulleys, or chain sprockets. The amount of resistance provided by a fan of a given size and gearing can be fine-tuned by increasing or decreasing the airflow through the fan. An air fan with open airflow will have the greatest resistance, and an air fan with partially or fully blocked airflow will have reduced resistance. The blocking of the airflow (e.g., through adjustable air vents) is analogous to the adjustment of the degree of shorting of electrical motors. Similarly, water-filled containers with propellers can be used to the same effect, wherein the depth or pitch of the propellers in the water can be adjusted, with greater depth or pitch leading to increased resistance, and vice-versa. In both air fans and water-filled containers, the resistance increases exponentially with speed, which is useful in some applications.

There is no requirement that the resistance mechanisms be applied to the front wheels, or to any set of wheels in particular. Many different configurations are possible, including resistance provided by the rear wheels, resistance provided by wheels only on one side, resistance provided by each of six wheels, etc. Further, continuous belts, treads, or track mechanisms (such as on a military tank) may be used in place of all or some of the wheels. Such embodiments are useful on soft surfaces such as sand or mud. Additionally, wheels may be connected to the resistance mechanisms through a variety of means. In some embodiments, one or more wheels are attached directly to the shaft of a motor, with the motor shaft acting as the axle of the wheel. In other embodiments, one or more wheels are attached directly to the shaft of a gear mechanism of a geared motor, with the gear shaft acting as the axle of the wheel. In other embodiments, one or more wheels may be attached to an axle, and wheel or axle may be connected to the resistance mechanism by wheels, gears, belts and pulleys, chains and sprockets, etc.

While the descriptions herein typically describe a weight sled with four wheels, other numbers of wheels may be used. A particularly useful embodiment is a three-wheeled version in which the two front wheels providing resistance are set wide apart, and a free-turning caster wheel is used in the rear, wherein the weight sled can be turned easily, with lateral resistance being applied against the turn by the wide-set front wheels. This embodiment is particularly useful for training pivot-and-turn exercises. Depending on the desired load-capacity, a twin-caster wheel centered in the rear or a pair of caster wheels set on each back corner may replace the one caster wheel previously described.

Another useful embodiment is a version where all four wheels are omni-wheels. Omni-wheels are a type of omni-directional wheel that do not pivot or swivel but can be moved freely in any direction on a two-dimensional surface without the wheel re-orientation of swivel casters Omni-wheels operate by employing smaller rollers around the circumference of a larger wheel, wherein the axle of the rollers is perpendicular to the axle of the larger wheel. When making forward/backward movements, the main wheel turns. When making lateral movements, the rollers turn. When making a combination of forward/backward and lateral movements, both the wheel and rollers turn. Exercises using this configuration when moving the weight sled in the frontal plane work the body's core significantly more than a weight sled moving in only the sagittal plane. Versions using omni-wheels in only the two rear positions allow for similar pivoting and swiveling of the weight sled as in the caster version.

If caster wheels and omni-wheels are undesirable or if noise is a consideration, ball bearing casters may be implemented. Ball bearing casters are a type of omni-directional wheel that can be moved freely in any direction on a two-dimensional surface without the wheel re-orientation of swivel casters and generate less noise than their caster counterparts. They may be installed as a single centered rear caster or a three-ball bearing version. All embodiments; rubber wheels, plastic wheels, caster wheels, omni-wheels, and ball bearing casters have application-specific uses and one may be chosen over the other to prioritize exercise variance, load-capacity, speed, storage, or noise considerations. In some embodiments, casters or omni-wheels may be used in conjunction with fixed direction wheels, and in other embodiments, casters or omni-wheels may be used without fixed direction wheels.

Furthermore, all wheel configurations can be augmented with a retracting mechanism to effectively remove a wheel or set of wheels for the purposes of storage or increasing the number of training exercises that may be achieved compared to a current weight sled. In the same manner, wheels may be mounted by any plurality of locking pins allowing the user to remove the wheel altogether or switch out for other types of wheels. An example of an exercise only possible by removing one or more wheels is supporting the rear end of the weight sled while the distal end is supported by wheels and the user pushes the two-wheeled version around a facility. An additional example is allowing a user to lock the direction of the weight sled by removing the one or more wheels that enable omni-directional motion or by locking them in place so that power is only applied unidirectionally. Removing or locking wheels by locking pins or retracting mechanisms also allows for tighter storage configurations.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

Definitions

"Caster" as used herein is weight-bearing wheel, typically mounted to a fork on the bottom of frame or chassis which allows heavy objects to be moved more easily. Types of casters include rigid (fixed direction) casters, swivel casters, and ball bearing casters. Swivel casters are designed to pivot about a point of attachment such that the angle of the axle relative to the point of attachment is free to change as forces in different directions are applied to the object to which the caster is attached. Swivel casters will typically have a horizontal offset from the point of attachment to the axle (often called a swivel lead) which causes the wheel to trail behind the point of attachment, causing the wheels to orient itself in the direction of motion of the object to which it is attached. Ball bearing casters has a large ball bearing for a wheel which is mounted in a bearing cage, allowing the ball bearing to roll in any direction along the ground surface. Casters may have additional features such as retractability, braking, and locking.

"Resistance mechanism" as used herein means any device configured to resist the movement of a weight sled when a force is applied to the weight sled. Resistance mechanisms include, but are not limited to, mechanical and electrical brakes; shorted or partially-shorted electric motors; anchors, weights, or devices that create friction with a ground surface; air fans and other devices that use air resistance; and fluid containers with propellers and other devices that use fluid resistance, including devices in which the viscosity of the fluid changes based on pressure or electrical current.

"Wheel" as used herein means any circular mechanism for bearing weight and allowing the weight to roll across a surface. Non-limiting examples of wheels according to this definition are solid wheels, spoked wheels, wheels with tires of various sorts, rail wheels for use on tracks, track wheels for use in guiding continuous belts, treads, or track mechanisms, and roller-bearing wheels. While most wheels will bear the weight on an axle running through the center of the wheel perpendicular to the circular shape, in the case of roller-bearing wheels, the weight may be borne on the outer surface of the wheel against bearings, or in some cases against bearings on the inner surface of an open circular wheel.

FIG. 1 is an orthogonal view of an exemplary multi-mechanism bias-correctable adjustable resistance weight sled. In this embodiment, the device has a frame (the terms "frame" and "chassis" are used herein interchangeably) 101 made of structurally-rigid materials. Square or angled metal beams can be used, but any material with sufficient rigidity to support weights 105 and resist deformation (either forward or laterally) may be used (e.g., the entire frame or chassis could be a single-piece carbon fiber frame). The frame or chassis may have with one or more crossbars 102 to provide lateral rigidity, although in some embodiments separate crossbars may not be necessary, and such lateral support may be integrated a single-piece or unibody frame or chassis (e.g., a single-piece carbon fiber frame or single-piece welded aluminum or steel frame, etc.). In this embodiment, a platform 103 is added to provide additional lateral support as well as providing a mounting surface for the resistance mechanisms 109. The weight sled 100 of this embodiment further comprises posts 104 onto which standard weightlifting plates 105 may be slid to temporarily affix them to the weight sled 100 during use. The weightlifting plates 105 provide inertial resistance and downward force gravity onto the wheels, to provide friction between the wheels and ground to keep the wheels from sliding against the ground due to the force of the resistance mechanisms 109. The weight sled 100 has handles 106 for use in pushing or pulling the weight sled. While the handles in this configuration are vertical, straight, round posts with horizontal supplemental handles, any configuration of handles that allows for manipulation of the weight sled 100 may be used (e.g., straight, curved, looped, angled, horizontal, vertical, etc.). In at least one embodiment, the handles can be configured to extend horizontally from the rear of the weight sled such that the sled can be lifted and pushed or pulled in the manner of a wheelbarrow. The weight sled 100 of this embodiment also has one or more tow loops 107, onto which a line may be tied or a tow hook attached for dragging the sled via a rope, cable, strap, or other line. In some embodiments, tow loops may be provided at multiple locations on the weight sled, such as tow loops as the front and back, so that the weight sled may be pulled from the tow loop at either end.

The weight sled 100 has a plurality of wheels 108, which may vary depending on the configuration or application. In this embodiment, four wheels 108 are used, but other embodiments may have more or fewer. While weightlifting plates 105 are shown in this embodiment, any heavy object may be used in their place to provide the inertial resistance and downward force on the wheels. In some embodiments, the weightlifting plates 105 are not necessary, and the weight sled 100 may be reconfigured so as to provide sufficient friction between the wheels without the use of heavy objects such as weightlifting plates 105. For example, the diameter of the wheels attached to the resistance mechanisms 109 may be increased to provide additional torque or the wheels may be made of a high-friction rubber compound to provide extra friction against the ground surface.

The resistance mechanisms of this embodiment are shorted, or partially-shorted, permanent magnet motors. As described above, the shorting or partial-shorting of the leads of the motors generates an electromagnetic field in the windings in the case of the motor during rotation of the shaft which resists the rotation of the permanent magnets affixed to the shaft of the motor. Having a plurality of such resistance mechanisms allows for different configurations of resistance. In this embodiment, resistance mechanisms on opposite sides of the weight sled 100 allows for a difference in resistance force on either side of the weight sled, allowing for resistance to lateral movement, bias-correction for ground surfaces with a grain direction, non-level ground surfaces, intentional asynchronous lateral resistance of varying degrees, and a tendency to self-correct for lateral movements of the weight sled. However, other configurations are possible for different applications, such as resistance mechanisms mounted linearly along the front to back axis of the weight sled 100 or resistance mechanisms mounted radially along the circumference of a circle to provide resistance against the rotation of a circular-shaped weight sled.

Further, in this embodiment, the resistance mechanisms are so-called "geared" motors, wherein gears are built into, or mounted onto, the motor housing, so as to reduce the motor shaft RPM to a lower RPM at an output shaft attached to the gears. As the wheels are attached to the output shaft of the gears and the wheels drive the rotation of the motors, a slower rotation of the wheels translates (through the gears) into a faster rotation of the motor shaft. Other configurations are possible, including the use of non-geared motors, wherein there is a one-to-one correlation between the rotation of the wheels and the rotation of the motor shaft.

Figure 2:
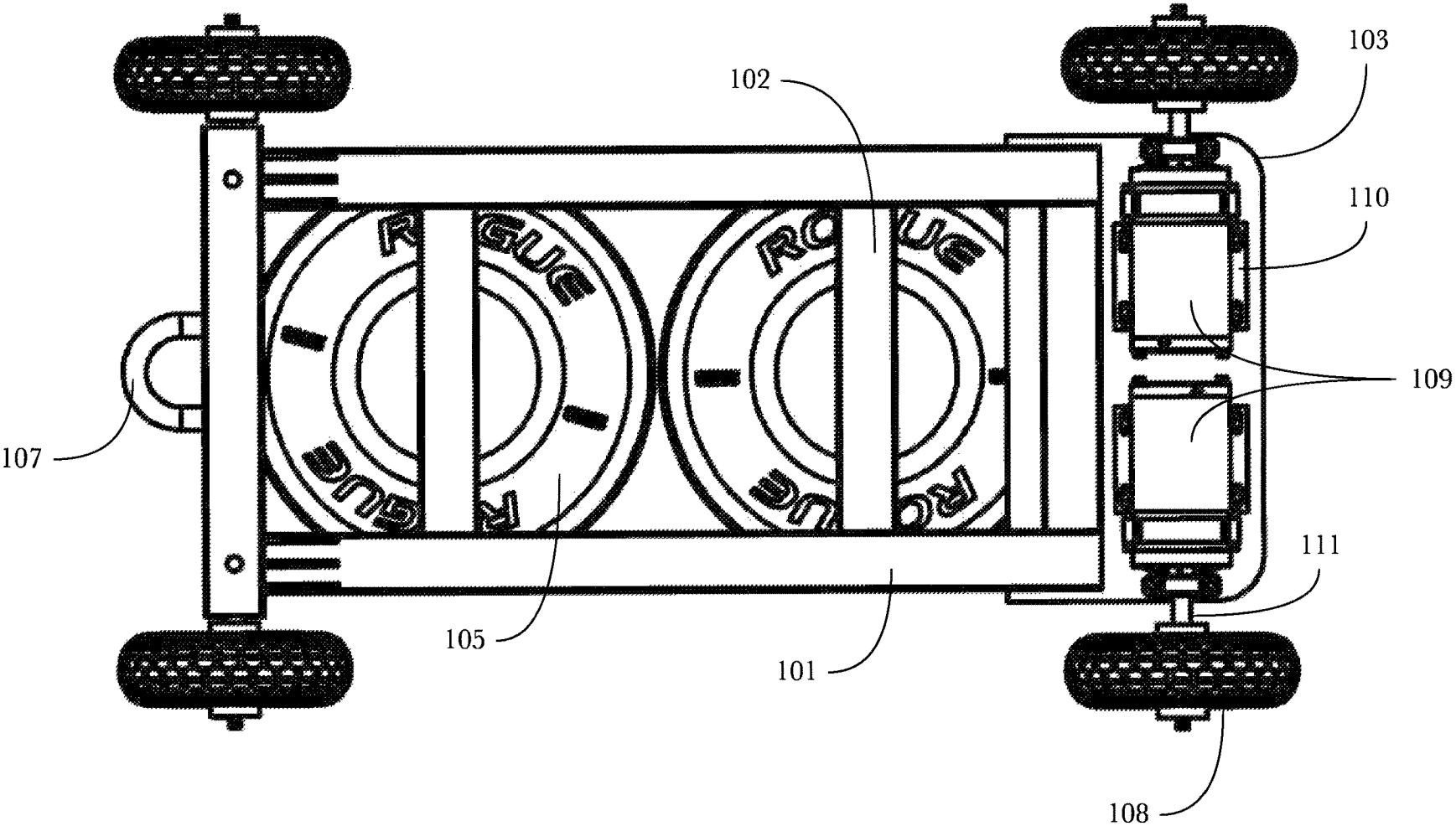
FIG. 2 is a bottom view of the exemplary multi-mechanism bias-correctable adjustable resistance weight sled.

FIG. 2 is a bottom view of the exemplary multi-mechanism bias-correctable adjustable resistance weight sled. In this view, it can be seen that the resistance mechanisms 109 are mounted to the platform 103 through use of mounting brackets 110 configured to hold the motor in a fixed position relative to the weight sled 100. Also shown in this view are the shafts 111 in which one end is attached to the motor housing with a relief bearing and the other end is attached to the wheels which acts as the axle of the wheels that drive the resistance mechanisms. For non-geared motors, the shafts 111 will be the motor shaft, while for geared motors, the shafts 111 will be the gear shaft. The frame or chassis 101, crossbars 102, weightlifting plates 105, tow loop 107, and wheels 108 are shown for reference.

Figure 3:
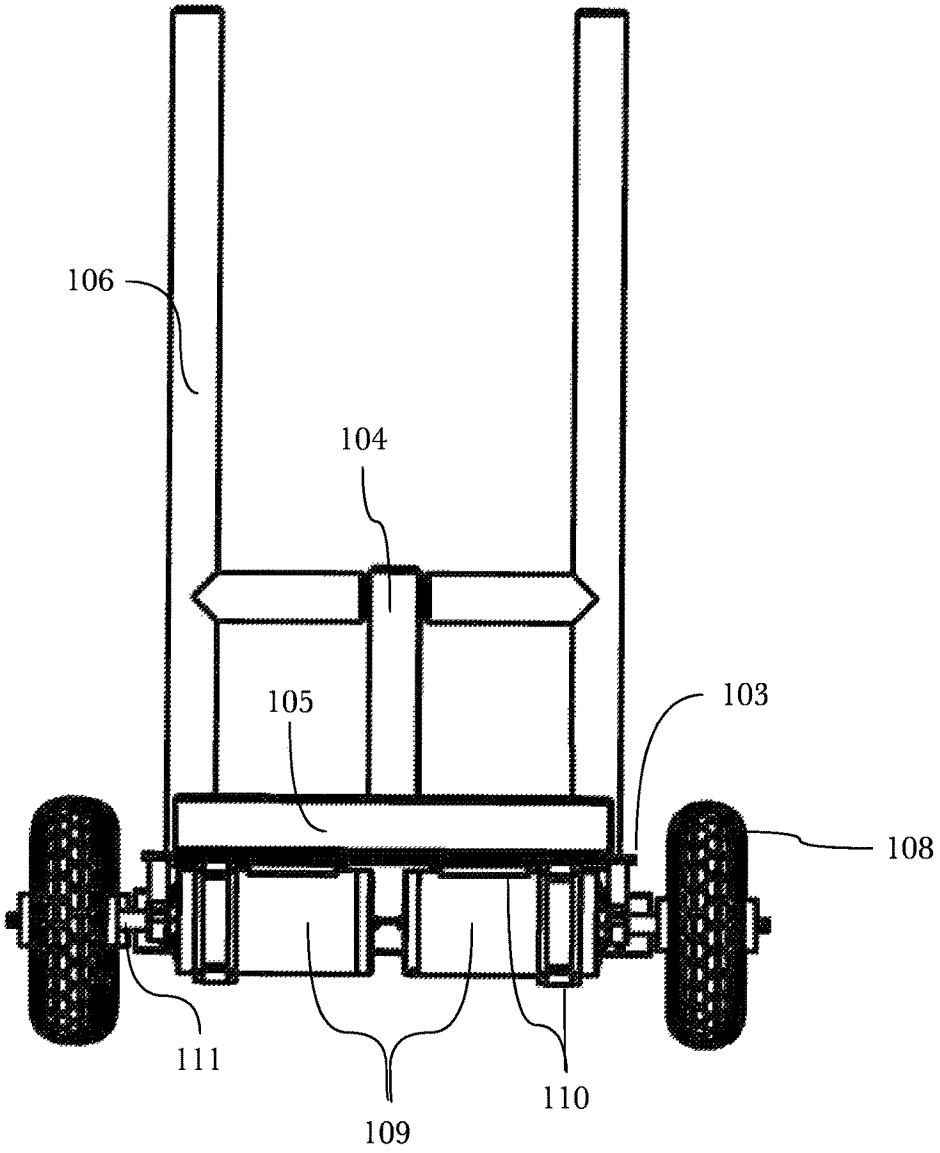
FIG. 3 is a front view of the exemplary multi-mechanism bias-correctable adjustable resistance weight sled.

FIG. 3 is a front view of the exemplary multi-mechanism bias-correctable adjustable resistance weight sled. In this view, it can be seen that the resistance mechanisms 109 are mounted below the platform 103 through the use of mounting brackets 110 configured to hold the motor in a fixed position relative to the weight sled 100. The height of the weight sled 100 above the ground surface (and therefore the center of mass of the weight sled) can be adjusted by changing the diameter of the wheels 108. The weight posts 104, weightlifting plates 105, handles 106, and shafts 111 are shown for reference purposes.

Figure 4:
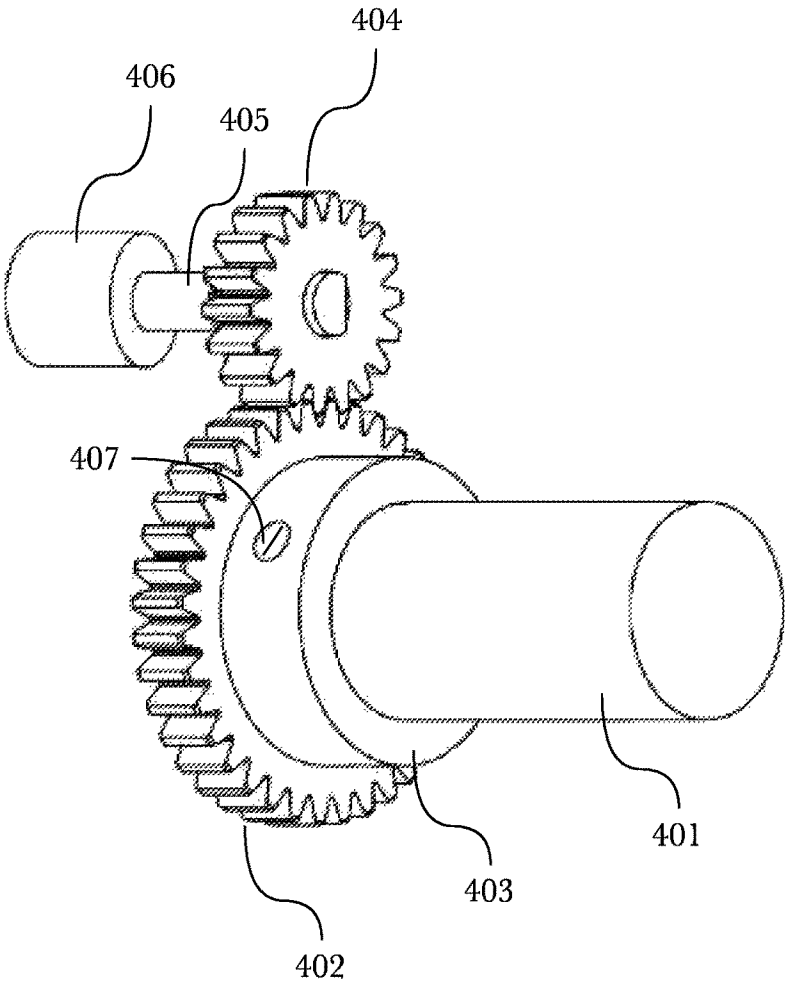
FIG. 4 is a view of a gear mechanism for a rotary encoder for capturing performance data.

FIG. 4 is a view of an exemplary gear mechanism for a rotary encoder for capturing performance data. In this embodiment, a first gear 402 is attached to a shaft 401 via a gear collar 403 using a set screw 407. The shaft 401 may be any shaft that rotates in some relation with a wheel of the weight sled, whether or not directly attached to the wheel and whether or not the wheel is associated with one of the resistance mechanisms. For example, the shaft 401 may be the motor shaft of a resistance mechanism, a gear shaft, or an axle of a free-turning wheel. The first gear 402 turns a second gear 404 that is attached to the shaft 405 of a rotary encoder 406. The rotary encoder 406 is an electro-mechanical device that converts the angular position or motion of its shaft 405 to analog or digital output signals. Many types of rotary encoders exist, but this embodiment assumes the use of a digital, incremental rotary encoder 406, meaning that the encoder detects only changes in position of the rotor shaft which are output as discrete square-wave changes in the rotary encoder's output signal. The degree of rotation of the rotary encoder 406 shaft for each signal change is determined by the resolution of the rotary encoder 406 (e.g., a 10-bit rotary encoder would have 1,024 changes per revolution, with each change representing 0.352 degrees). The signal from the rotary encoder can be transmitted to a computing device to make various calculations about the speed and acceleration of the shaft which, combined with other information about the weight sled such as the weight's mass, the resistance force of the resistance devices, the size of the wheels, and gearing from the wheels to the rotary encoder 406 shaft 405 can be used to calculate the power, speed, acceleration, and other characteristics of the weight sled.

While this example shows a rotary encoder driven by a gear mechanism, a wide range of mechanisms may be used to drive the rotary encoder shaft, including but not limited to wheels, gears, belts and pulleys, chains and sprockets, etc.

Figure 5:
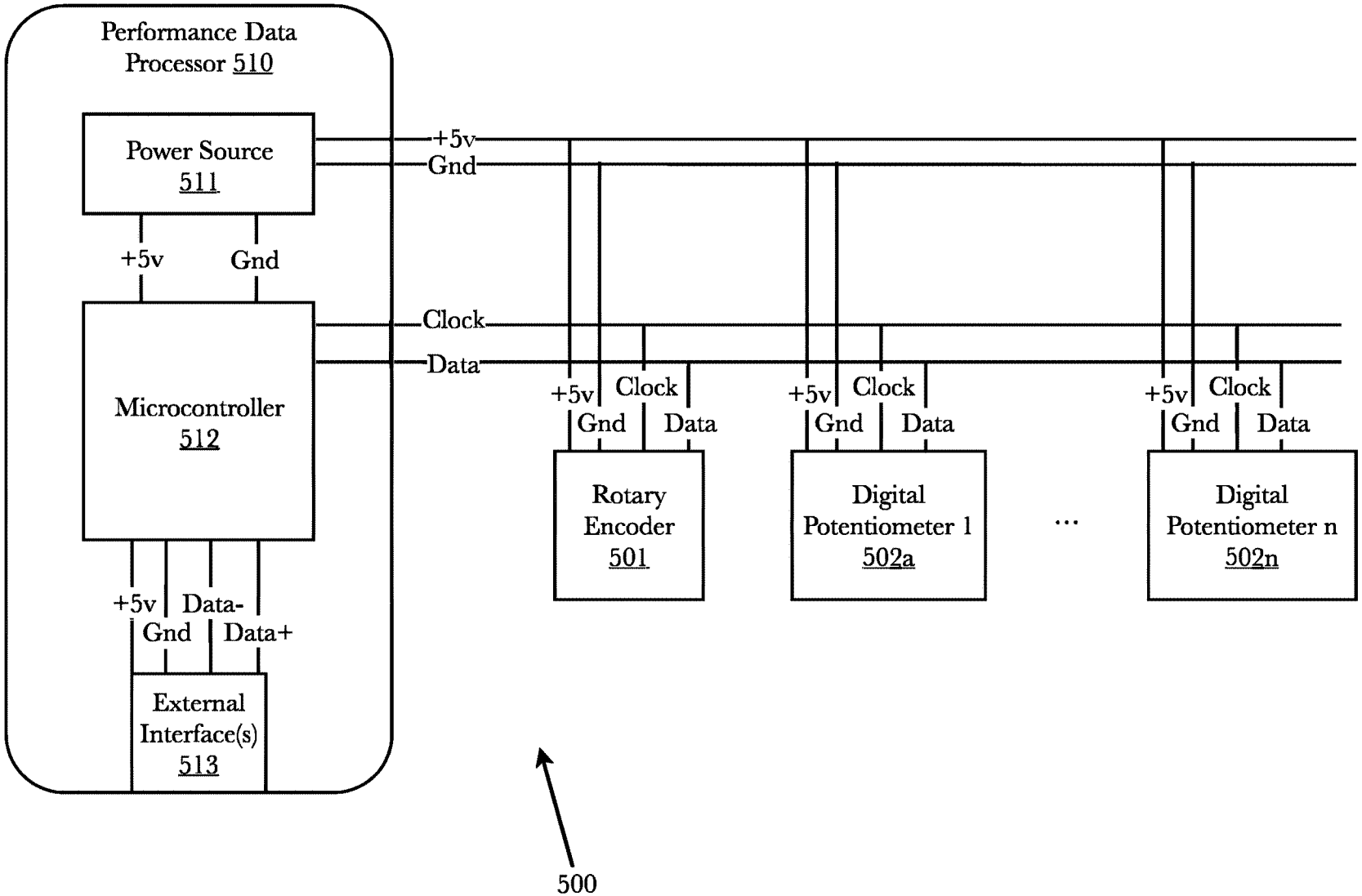
FIG. 5 is an exemplary system architecture diagram for a control system for multi-mechanism bias-correctable adjustable resistance weight sled.

Further, many devices other than rotary encoders may be used to measure or calculate wheel speed, power, speed, acceleration, and other characteristics of the weight sled. As just a few examples: accelerometers may be used to measure acceleration of the sled; voltmeters and/or ammeters may be used to measure the electrical power produced by the motors as a result of the EMF backforce; global positioning system (GPS) devices can be used to measure changes in the sled's location as a function of time; pressure sensors can be used to measure the mass of weight plates placed on the sled (and added to the sled's known empty mass to get a total mass for the weight sled); and pressure sensors on the handles or between the handles and sled frame can be used to measure the pressure exerted on the handles. Readings from a second encoder may be used to determine relative speeds of the wheels and further determine the power exerted when the sled is turning. The measurements provided by each of these sensors can be used to make the same calculations about power, speed, acceleration, and other characteristics of the weight sled when combined with other information about the weight sled such as the weight's mass. In some cases, measurements from multiple sensors may be used to make, refine, or augment these calculations. For example, data from an accelerometer may be combined with data from an ammeter and the mass of the weight sled to determine the total power being exerted at a given time, accounting for both the weight of the sled and the resistance provided by the resistance mechanisms. FIG. 5 is an exemplary system architecture diagram for a control system 500 for multi-mechanism bias-correctable adjustable resistance weight sled. A control unit 510 comprises a power source 511, a microcontroller 512, and an external interface 513. The control unit receives data from a rotary encoder 501, an electro-mechanical device that converts the angular position or motion of a shaft or axle to analog or digital output signals. Many types of rotary encoders exist, but this embodiment assumes the use of a digital, incremental rotary encoder 501, meaning that the encoder detects only changes in position of the rotor shaft which are output as discrete square-wave changes in the rotary encoder's output signal. The control unit 510 further controls the operation of a plurality of digital potentiometers 502*a-n*, each of which adjusts the resistance across the leads of a given motor. In this embodiment, the power source is batteries, but in other embodiments the power source 511 may be supplied from other sources. For example, power could be supplied to the control unit 510 from the electricity generated by the weight sled's motors, obviating the need for battery power, or power may be supplied by an external battery through the external interface 513. The external interface 513 is an interface capable of communicating with another electronic device, and may be wired or wireless. In this embodiment, a standard universal serial bus, Type A (USB-A) interface is shown with four wires corresponding to +5 volts, ground, data-, and data+, but other configurations are possible, including a wireless radio configured to connect to other wireless devices through wireless protocols such as Bluetooth and WiFi. A person of ordinary skill in the art will recognize that this configuration is simply one of many such configurations, and that the various components may be contained in, or distributed among, various other components and/or locations.

The microcontroller 512 is a small computing device with one or more processors, a memory, communications controllers, and one or more inputs and outputs. Microcontrollers in this type of application are typically pre-programmed for the intended use. The microcontroller 512 is used to receive input signals either from sensors or other computing devices, and receive signals from the rotary encoder 501 in accordance with the signals received. In this embodiment, the microcontroller 512 contains an inter-integrated circuit bus (also known as I2C) which allows for fully-addressable serial communication with slave devices such as the rotary encoder 501 and the digital potentiometers 502*a-n*, using common wires for +5 v and ground (for power), a clock signal, and data. While not required in this embodiment, the rotary encoder 501 may also contain a communications controller allowing for I2C serial communications with the microcontroller 512. In this embodiment, the rotary encoder 501 outputs square-wave signals indicating rotation of the rotary encoder 501 shaft. The signals from the rotary encoder 501 are received by the microcontroller 512, which counts each change in the signal (typically from low to high, but the reverse is also possible). The degree of rotation of the rotary encoder 501 shaft for each signal change is determined by the resolution of the rotary encoder 501 (e.g., a 10-bit rotary encoder would have 1,024 changes per revolution, with each change representing 0.352 degrees). In addition to counting the number of changes, the micro-controller can use timers to determine the frequency of changes (corresponding to the angular velocity of the rotary encoder 501 shaft) and changes in the frequency (corresponding to acceleration or deceleration of the rotary encoder 501 shaft). Likewise, each digital potentiometer 502*a-n* also contains an I2C controller, allowing the digital potentiometers 502*a-n* to be individually addressed as slave devices by the microcontroller, and their resistances to be adjusted individually, which changes the resistance across the leads of each motor and thus the resistance force provided by each motor.

Although this example uses the I2C serial communications protocol, any addressable communication protocol may be used, including serial and parallel communications protocols, such as serial to peripheral interface (SPI), universal asynchronous receiver-transmitter (UART), etc. In some embodiments, direct pinouts from the microcontroller may be used instead of addressable communications protocols. In some embodiments, wireless communications between the microcontroller 512 and the rotary encoder 501 may be used instead of wired communications.

The control system 500 as described herein may be programmable to adjust the resistance of the resistance mechanisms in any manner desired, including any combination of static, dynamic, and variable adjustment of the resistance provided by any or all of the resistance mechanisms during use. For example, an application on a mobile device may connect to the control system 500 and allow the user to program the weight sled to provide variable resistance to the brake sled during use, such as providing maximum resistance for the first 10 meters, moderate resistance for the next 10 meters, and then minimal resistance afterward. Other examples include alternating resistance of the right and left motors or randomizing the resistance levels to keep users engaged. The control system may be configured to allow for wireless connectivity between weight sleds or to allow simultaneous connectivity from multiple weight sleds to a mobile device, such that comparative data from multiple weight sleds may be used to create leaderboards, provide comparative data to coaches of a team, etc.

Figure 6:
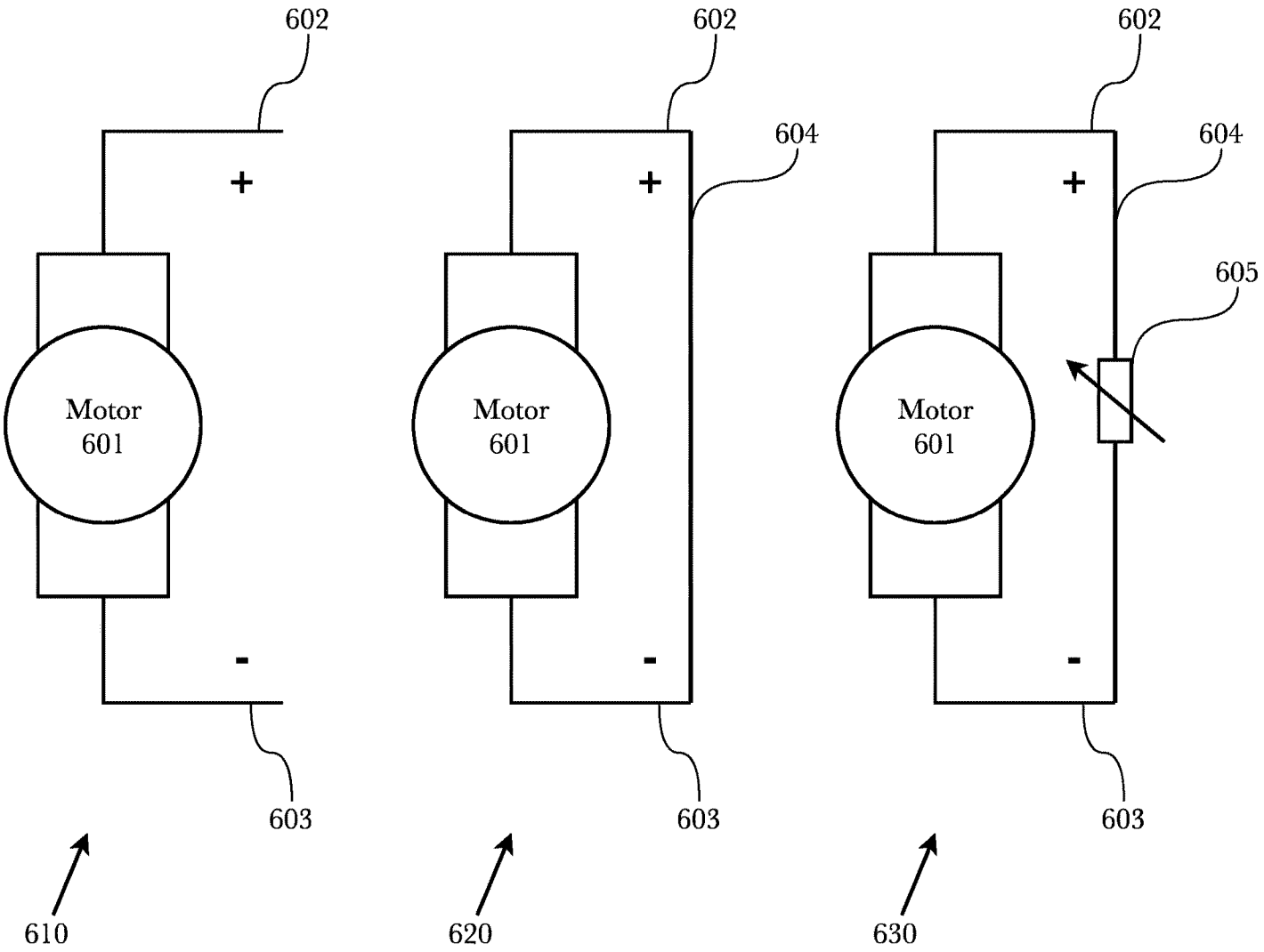
FIG. 6 is a diagram showing the use of a permanent magnet motor as a passive torque resistance device.

FIG. 6 is a diagram showing the use of a permanent magnet motor as a passive torque resistance device. A permanent magnet motor 601 is an electric motor with wire windings surrounding a rotor to which are attached permanent magnets. The electrical power leads of the motor 602 and 603 are normally used to provide electrical power to the motor, causing the rotor of the motor 601 to turn due to a magnetic field generated by the windings which pushes or pulls against the permanent magnets of the rotor. When the leads of the motor are not connected to power as shown in 610, no magnetic field is generated by the windings, and the rotor is free to turn without electromagnetic resistance (minus the detent torque that is inherent in permanent magnet electric motors). However, when the leads of the motor 601 are shorted together by a wire 604 as shown in 620 the permanent magnets of the rotor generate current in the windings which creates a magnetic field that resists further turning of the rotor. The magnetic field resistance against the rotor is proportional to the angular velocity of the rotor (i.e., the faster the rotor spins, the more resistance is generated in a linear relationship). Importantly, the amount of resistance between the leads can be varied, which changes the amount of resistance against the rotor. As shown in 630, if a variable resistor 605 is placed between the leads of the motor 602, 603, the amount of resistance of the wire 604 (and hence the amount of shorting of the motor) can be adjusted. The greater the resistance, the less shorting of the motor, and the more freely the rotor will turn. Conversely, the less resistance, the more shorting of the motor, and the less freely the rotor will turn. As the amount of resistance through the variable resistor 605 can be adjusted through a very wide range (a few ohms to millions of ohms, depending on the values of the variable resistor 605), very fine-grained control over the amount of resistance provided by the motor 601 can be obtained.

Other electromechanical means may be used to adjust the degree of shorting between the leads of a motor. Another way to provide fine-grained, electronically-adjustable control of the degree of shorting is to use a transistor instead of a potentiometer. The leads of the motor can be connected to the collector and emitter of the transistor, with current to the base of the transmitter being adjusted to adjust the amount of electrical connectivity across the collector and emitter. The voltage to the base can be adjusted, although fine-grained control is difficult with this method. The better application is to use a micro-controller to control switching of the transistor using pulse width modulation (PWM). Using PWM, the transistor can be switched on and off very rapidly, with the amount of on time relative to off time being adjusted by the width of the on pulse to the base relative to some period of a square wave signal. For example, if the selected period is 1 millisecond (1 ms), the transistor can be switched on and off 1,000 times per second. If the on pulse (i.e., the high voltage of the square wave signal to the base) is 0.1 ms, and the off pulse (i.e., the low or zero voltage of the square wave signal to the base) is the remaining 0.9 ms, the transistor will be on (and conducting electricity across the collector and emitter) 10% of the time. The use of a transmitter with PWM to adjust the resistance of the resistance mechanism provides even more precise control of the degree of shorting between the motor leads.

This principle of using back EMF in a motor as a passive torque or force generator is described mathematically as follows. When the motor is shorted as shown in 620, the electrical equation for the motor is:

$$V = iR + L\frac{di}{dt} + Kw$$

where V is the applied voltage across the terminals, i is the current in the system, R is the electrical resistance across the motor terminals, L is the inductance of the windings, K is the torque constant or back EMF constant (numerically equivalent), and w is the angular velocity of the motor shaft.

As we apply no voltage and are assuming operating the system at steady state in this example, the equation simplifies to:

$$0 = iR + 0 + Kw,$$

or the magnitude of $$i = \frac{Kw}{R}$$

Because we know the angular velocity, w, from the rotary encoder, we calculate torque with the following equation:

$$T = Ki = \frac{K^2 w}{R}$$

Force can be calculated by setting T=Fr where F is force and r is the radius of the wheel:

$$F = \frac{K^2 w}{Rr}$$

This force can be multiplied as we have two wheels. Notice that it is possible to increase the force by decreasing the electrical resistance R in the system, and vice-versa. By way of a potentiometer, rheostat, or digital potentiometer we can either changer this resistance manually or digitally over wireless or wired connection. For example, a mobile phone could be used to change the resistance of a digital potentiometer to adjust the resistance provided by at least one of the plurality of resistance mechanisms.

By combining the above calculations with other information about the weight sled such as the weight's mass, the resistance force of the resistance devices, the size of the wheels, and gearing from the wheels to the rotary encoder 406 shaft 405 can be used to calculate the distance traveled, the velocity (derivative of the distance) of the weight sled, the acceleration (derivative of velocity), of the weight sled, and the energy and power (energy over time) expended by the user in moving the weight sled. These calculations may be transmitted to a computing device (e.g., a mobile phone, tablet, or fixed display on the weight sled, etc.) for display to the user or for data storage.

Figure 7:
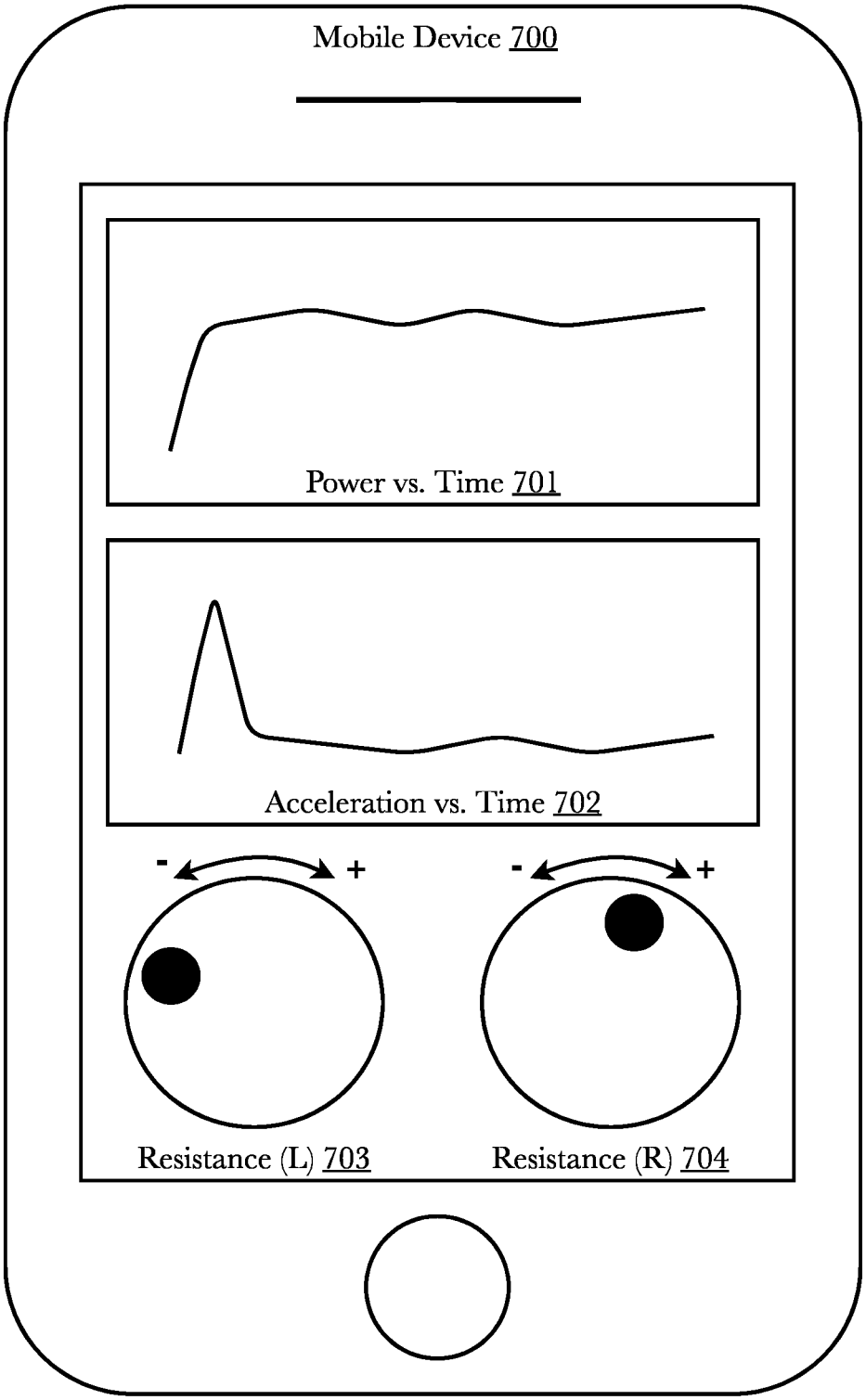
FIG. 7 is an exemplary display and control implementation on a wireless mobile device.

FIG. 7 is an exemplary display and control implementation on a wireless mobile device. A mobile device 700 is shown, which may be a mobile phone, tablet, or other computing device capable of transmitting, receiving, and displaying data. In this example, two windows 701, 702 on the screen of the device display data transmitted from a control unit on the weight sled. One window displays a chart showing power expended versus time 701, and the other window displays a chart showing acceleration versus time 702. The calculations for the data in the charts may be provided by a control unit on the weight sled, or the weight sled may simply transmit raw data for calculations to be made on the mobile device 700. Many other possible types of data may be shown, such as distance traveled, speed, total power expended, etc. Further, the mobile device may be used to control the resistance of the resistance mechanisms on the sled. In this example, a left-hand-side resistance dial 703 is shown which adjusts the resistance mechanism on the left-hand side of the weight sled, and a right-hand-side resistance dial 704 is shown which adjusts the resistance mechanism on the right-hand side of the weight sled. These dials may be operated by touching the on-screen dial and sliding one's finger in a leftward or rightward circular motion to mimic the turning of a physical dial. Many other types of physical or virtual controls may be used such as dials, sliders, and switches. The mobile device may transmit and receive data with the control unit on the weight sled via any wired or wireless means of communication, with common wireless implementations being use of Bluetooth and WiFi protocols.

Many other implementations of data transmission and display may be used, including displays mounted on the weight sled. Such displays may be fixed or removable, wired or wireless, and may be purely display devices such as liquid crystal displays (LCDs) or may be computing devices such as tablet computers. Data may be stored on the device or wirelessly transmitted off the device. Any type of fitness related data that can be calculated from sensors on the weight sled or from a device attached to the weight sled (e.g., accelerometers or GPS device in a mobile phone) may be displayed.

Figure 8:
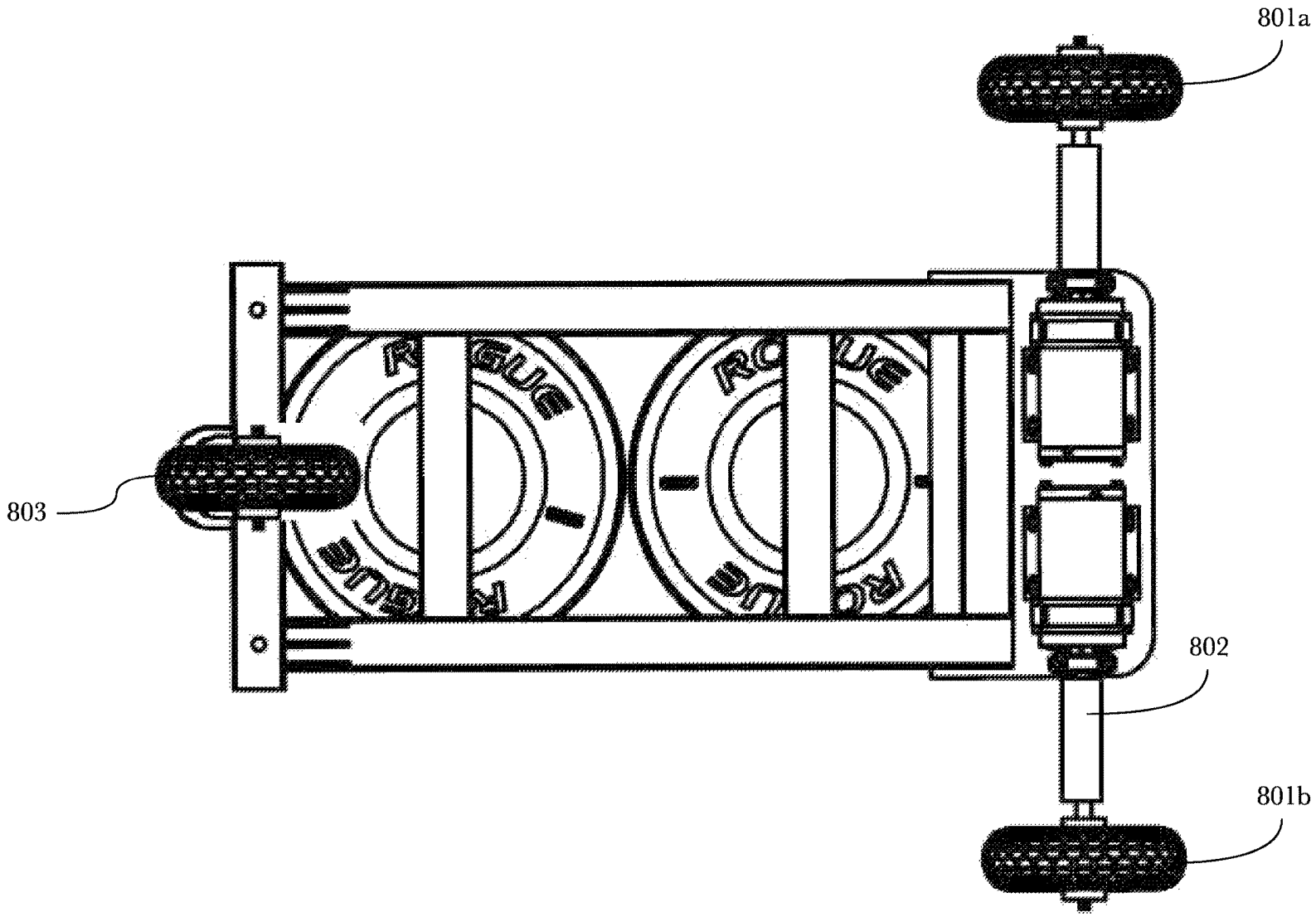
FIG. 8 is a bottom view of an alternate wide-bodied, three-wheeled embodiment of a weight sled.

FIG. 8 is a bottom view of an alternate wide-bodied, three-wheeled embodiment of a weight sled. In this alternate embodiment, the lateral movement and control of the weight sled is emphasized by placing the wheels 801*a,b* to which the resistance mechanisms are attached further from the center line of the weight sled. This may require additional axle supports or extensions 802 affixed to the weight sled to provide additional stiffness against flexing due to the longer lever arm of the longer axle. The further the front wheels 801*a,b* are from the center line of the weight sled, the more the difference in resistance during lateral movements is emphasized because the wheel on the outside of the turn moves in a larger arc (and thus spins faster) than a wheel with a shorter axle. The faster the rotation of the outside wheel, the greater the resistance generated by the resistance mechanism associated with that wheel. Also, rather than have a pair of wheels in the back, a single wheel 803 is attached to the weight sled on a caster or swivel, such that the back end of the weight sled can easily be moved laterally. Additionally, this embodiment amplifies the lateral force needed to keep the sled going in the intended direction via the intentional varying of resistance using a device such as the mobile device from FIG. 7.

It is possible, using this embodiment, to push the back of the weight sled in a circular motion, with the center of the circle being the perpendicular intersection of the center line of the sled and the center line of the axis of the wheels (i.e., directly between the motors at the center line of the sled). In this application, one front wheel will turn forward and the other will turn backward at the same rate, both generating resistive force against the circular movement of the back end of the sled. An alternate arrangement for this application is to have a circular weight sled with wheels and one or more resistance mechanisms (e.g., motors) mounted radially from the center of the circular weight sled.

Figure 9:
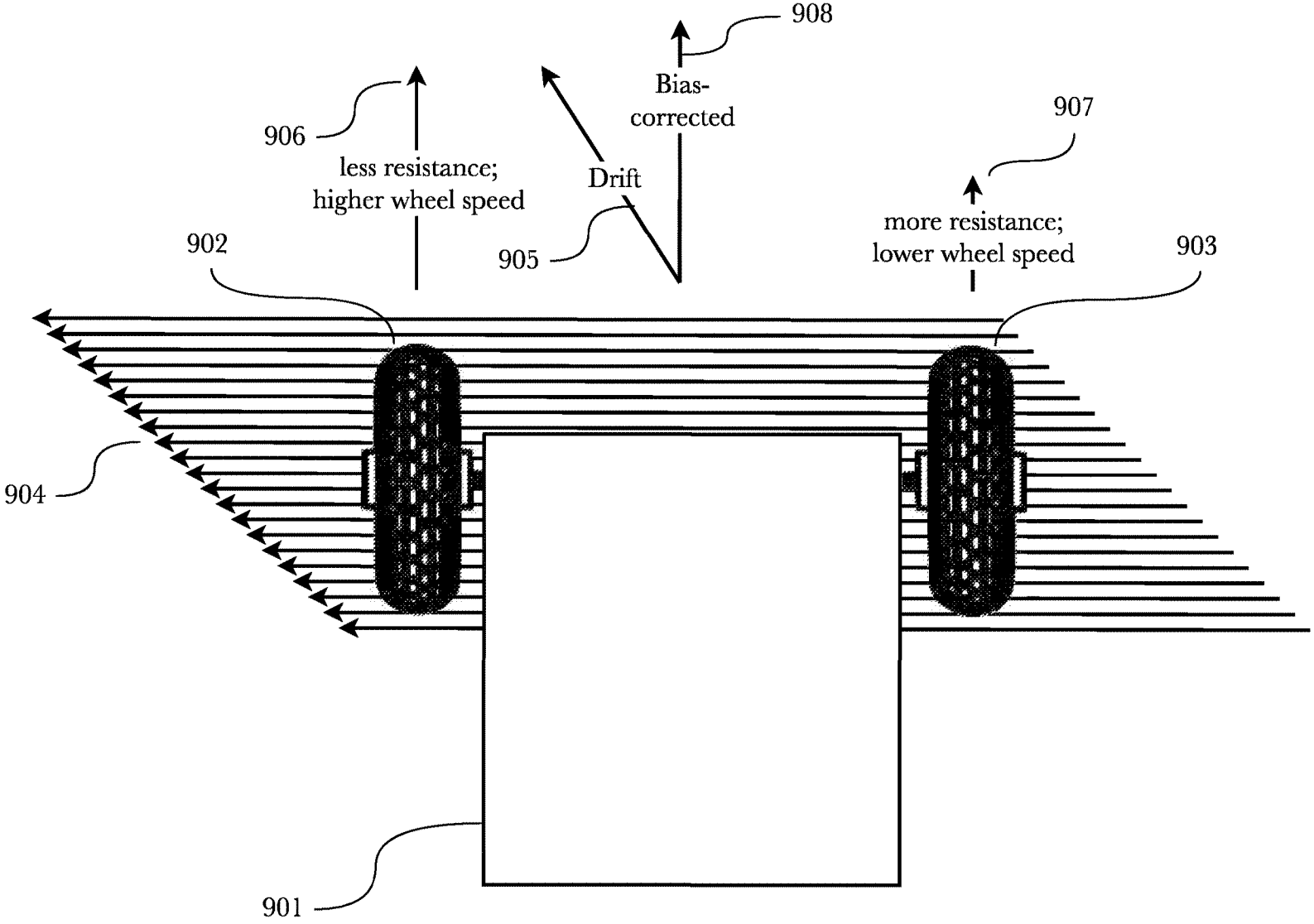
FIG. 9 is a diagram showing directional bias-correction of a weight sled using differential wheel resistance.

FIG. 9 is a diagram showing directional bias-correction of a weight sled using differential wheel resistance. In this diagram, the front half of a weight sled 901 is shown with the two front wheels 902, 903 being driven forward on a surface with a directional bias in the direction indicated by the arrows 904. The directional bias 904 may be caused by any factor tending to cause the weight sled 901 to drift 905 in the direction of the bias 904 as the weight sled 901 is pushed or pulled forward. For example, the directional bias 904 may be caused by a downward slope, a weave or pattern in an artificial turf or other surface that tends to push the wheels in a certain direction, etc. Whatever the cause of the directional bias 904, the direction of motion of the sled can be bias-corrected 908 such that the sled moves in the intended forward direction instead of drifting 905 in the direction of the bias 904. The bias-correction 908 is accomplished either by reducing the resistance 906 of the wheel 902 in the direction of bias (in this case the left wheel 902), resulting in a higher wheel speed and tending to cause the weight sled 901 to turn away from the directional bias 904, or by increasing the resistance 907 of the wheel 903 in the direction of bias (in this case the right wheel 903), resulting in a lower wheel speed and also tending to cause the weight sled 901 to turn away from the directional bias 904, or both methods may be used together. This bias-correction 908 may be performed manually, or may be performed automatically by feeding data from gyroscopes, accelerometers, GPS, lasers, video object recognition, or other sensors to a microcontroller to determine the direction and/or drift of the weight sled and adjust the resistance mechanism of each wheel, accordingly.

Figure 10:
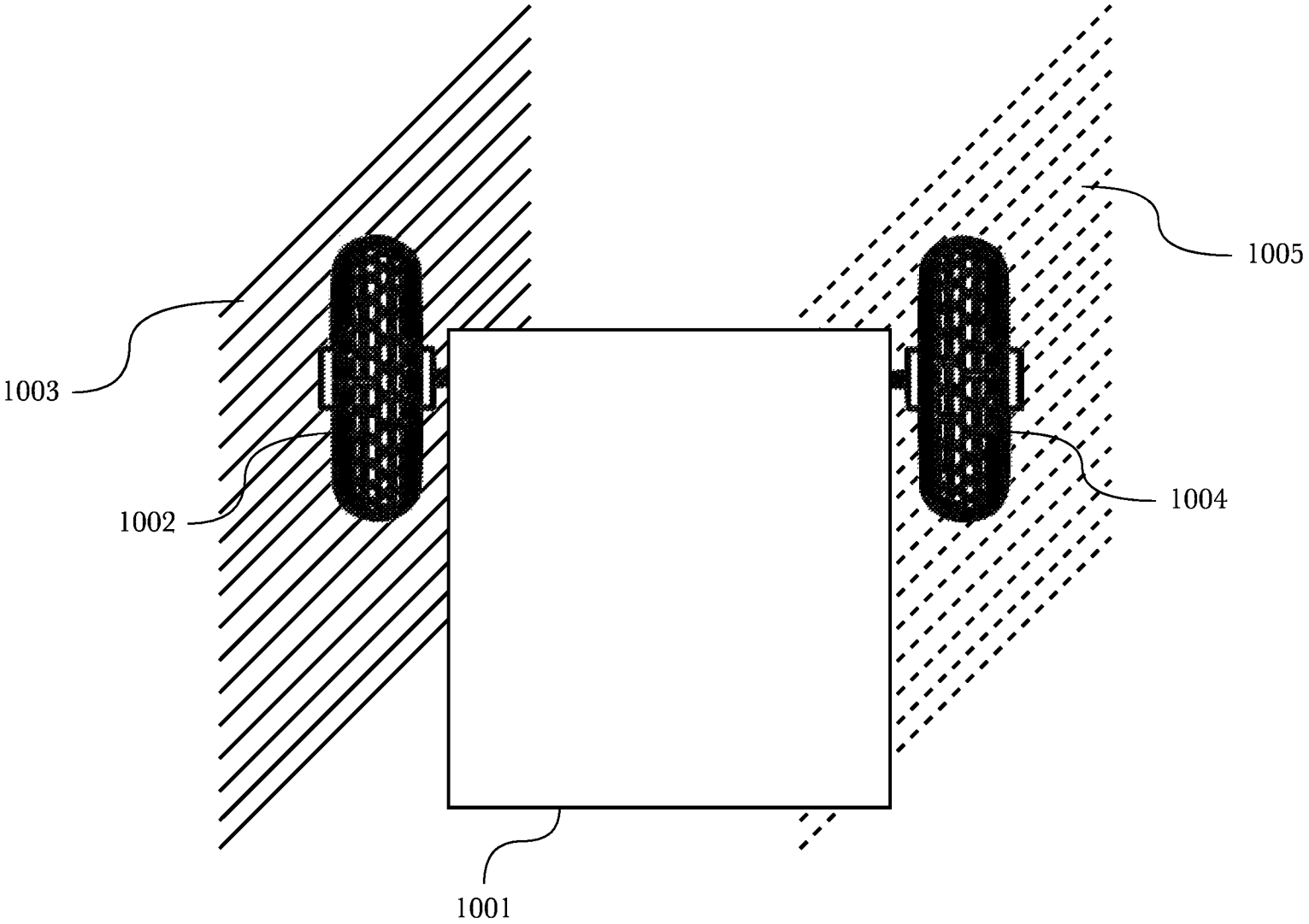
FIG. 10 is a diagram showing wheel skid control of a weight sled using differential wheel resistance.

FIG. 10 is a diagram showing wheel skid control of a weight sled using differential wheel resistance. In this diagram, the front half of a weight sled 1001 is shown with the two front wheels 1002, 1004 being driven forward on surfaces with different coefficients of friction. In this example, the left front wheel 1002 is being driven forward on a surface with a higher coefficient of friction 1003 (e.g., a hard surface such as pavement) and the right front wheel is being driven forward on a surface with a lower coefficient of friction 1005 (e.g., a softer surface such as dirt or gravel). In such a case, one or both of the wheels may experience slippage or skidding, with the right front wheel 1004 being more likely to experience slippage or skidding than the left front wheel 1002. The wheel slippage may be controlled by monitoring the period of rotation of each wheel and comparing it to an expected value (e.g., the relative period of rotation of the other wheel or an expected period of rotation calculated using the force applied to the sled, the weight of the sled, the wheel circumference, etc.) and increasing or decreasing the resistance on the affected wheel. For example, if the period of rotation of one wheel (in this case, the right wheel 1004) suddenly slows significantly relative to the period of rotation of the other wheel (in this case, the left wheel 1002), thus indicating slippage or skidding, the resistance provided by the resistance mechanism of the slipping of skidding wheel (here, the right wheel 1004) can be reduced until both wheels 1002, 1004 are again rotating at the same period of rotation. Further, the period of rotation of any non-skidding wheels (in this example, just the left wheel 1002) can be monitored against an expected value, and the resistance increased until the period of rotation falls below the expected value, thus maximizing the force that can be applied to the weight sled 1001 for any given combination of surfaces. These slippage and skidding reduction techniques may be performed manually, or may be performed automatically by feeding data from a rotational speed indicator (e.g., a rotary encoder or other sensor configured to measure the period of rotation of a wheel) to a microcontroller to determine the period of rotation of each wheel and adjust the resistance mechanism of each wheel, accordingly.

Figure 11:
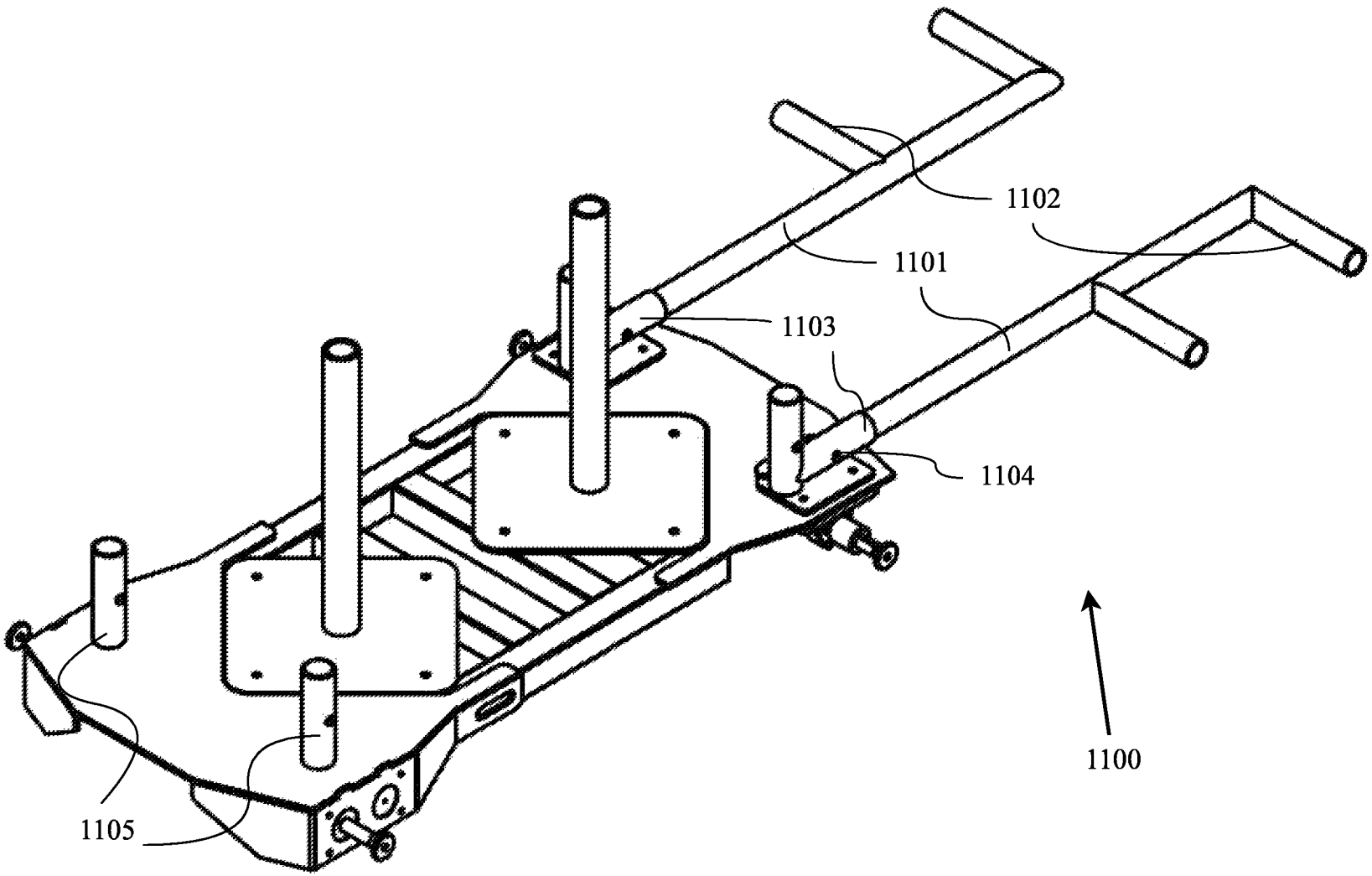
FIG. 11 shows an alternative straight handle arrangement, including a device for adjusting the orientation of the handles from horizontal to vertical.

FIG. 11 shows an alternative straight handle arrangement, including a device for adjusting the orientation of the handles from horizontal to vertical. In this arrangement, a pair of handles 1101, is provided each comprising a main shaft 1101 and one or more optional appendages 1102. The handles may be made of any rigid material (e.g., solid metal shafts, metal tubes, plastic tubes or shafts, wood, etc.) and of any cross-sectional shape (e.g., round, square, triangular, etc.). The optional appendages 1102 facilitate gripping of the handles 1101 on axes and orientations different from that of the main shaft 1101. A connector 1103 attached to the weight sled allows each of the handles 1101, to be attached to the weight sled. In this embodiment, the connector 1103 is a bi-directional tubular connector into which the end of the main shaft 1101 of each handle 1101, may be inserted to affix the handle to the weight sled. In other embodiments, however, the connector 1103 may be multi-angled, ratcheted, or rotatable with a locking mechanism, such that the handles 1101, can be fixed at varying angles between horizontal and vertical. The main shaft 1101 and the connector 1103 may have aligning sets of holes 1104 through which pins or rods may be inserted to further secure the handles 1101, to the connector 1103. The main shaft 1101 of each handle 1101 may be inserted either into the horizontal or the vertical portion of the connector, thus changing the position of the handles from a horizontal position (for dead lifting and for wheelbarrow pushing/pulling) to a vertical position (for horizontal pushing/pulling). In this arrangement, the handles 1101, are shown in a horizontal position. Other handle arrangements are possible by inserting the handles 1101 into the connector 1105 on the opposite side of the weight sled. This effectively reverses the direction of the weight sled and allows for new uses of the weight sled.

Figure 12:
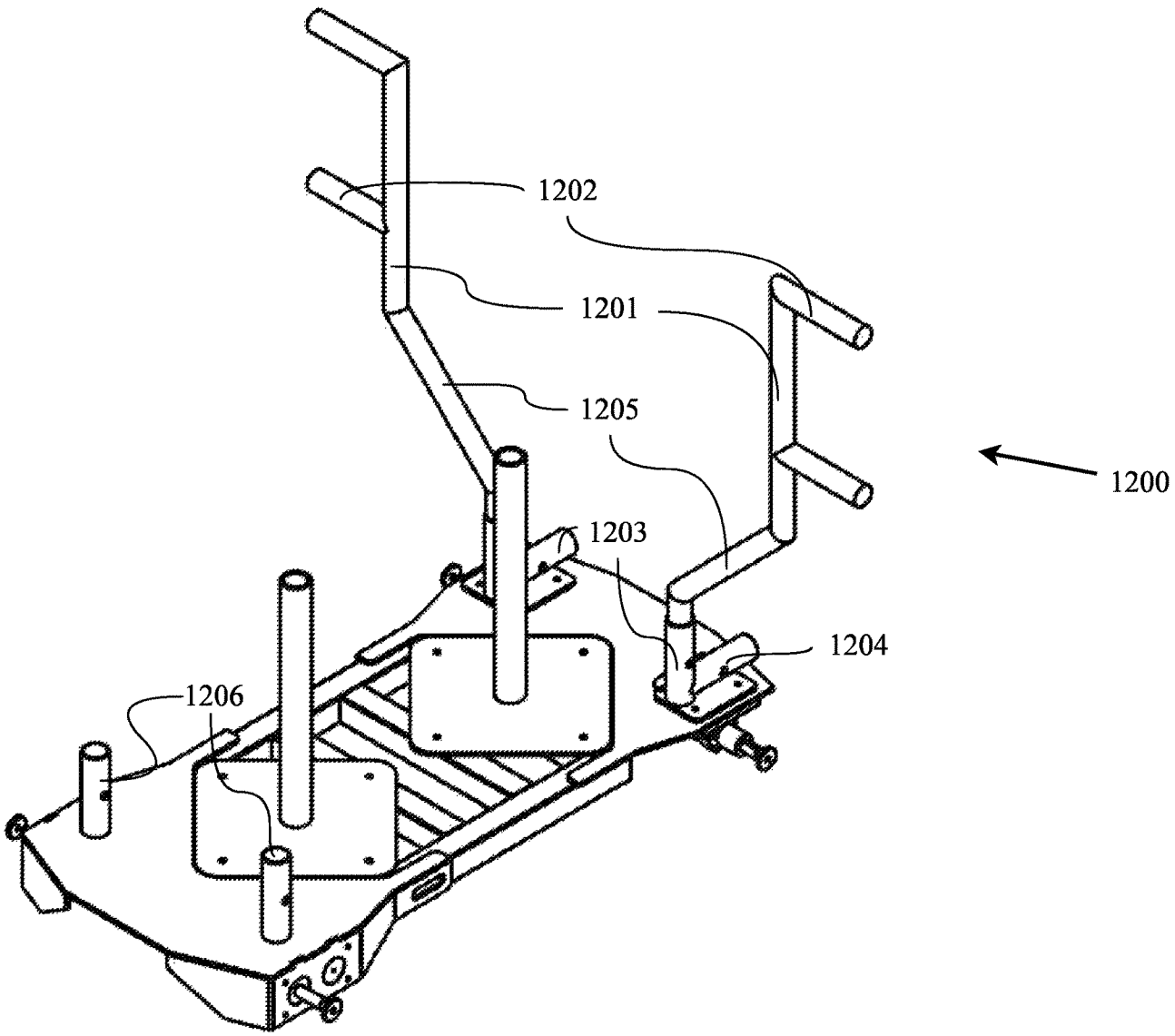
FIG. 12 shows an alternative wide handle arrangement, including a device for adjusting the orientation of the handles from horizontal to vertical.

FIG. 12 shows an alternative wide handle arrangement, including a device for adjusting the orientation of the handles from horizontal to vertical. In this arrangement, a pair of handles 1201, is provided each comprising a main shaft 1201 and one or more optional appendages 1202. The handles may be made of any rigid material (e.g., solid metal shafts, metal tubes, plastic tubes or shafts, wood, etc.) and of any cross-sectional shape (e.g., round, square, triangular, etc.). The optional appendages 1202 facilitate gripping of the handles on axes and orientations different from that of the main shaft 1201. In this embodiment, the main shaft 1201 further comprises an angled section 1205 which widens the gap between the sections of the main shaft 1201 at the locations where the main shaft 1201 is gripped, allowing a wider grip, stance, and more room to move laterally between the handles 1201. A connector 1203, 1206 attached to the weight sled allows each of the handles 1201 to be attached to the weight sled. In this embodiment, the connector 1203 is a bi-directional tubular connector into which the end of the main shaft 1201 of each handle 1201 may be inserted to affix the handle to the weight sled. In other embodiments, however, the connector 1203 may be multi-angled, ratcheted, or rotatable with a locking mechanism, such that the handles 1201 can be fixed at varying angles between horizontal and vertical. The main shaft 1201 and the connector 1203, 1206 may have aligning sets of holes 1204 through which pins or rods may be inserted to further secure the handles 1201 to the connector 1203, 1206. The main shaft 1201 of each handle 1201 may be inserted either into the horizontal or the vertical portion of the connector, thus changing the position of the handles from a horizontal position (for dead lifting and for wheelbarrow pushing/pulling) to a vertical position (for horizontal pushing/pulling). In this arrangement, the handles 1201, 1202 are shown in a vertical position.

Figure 13:
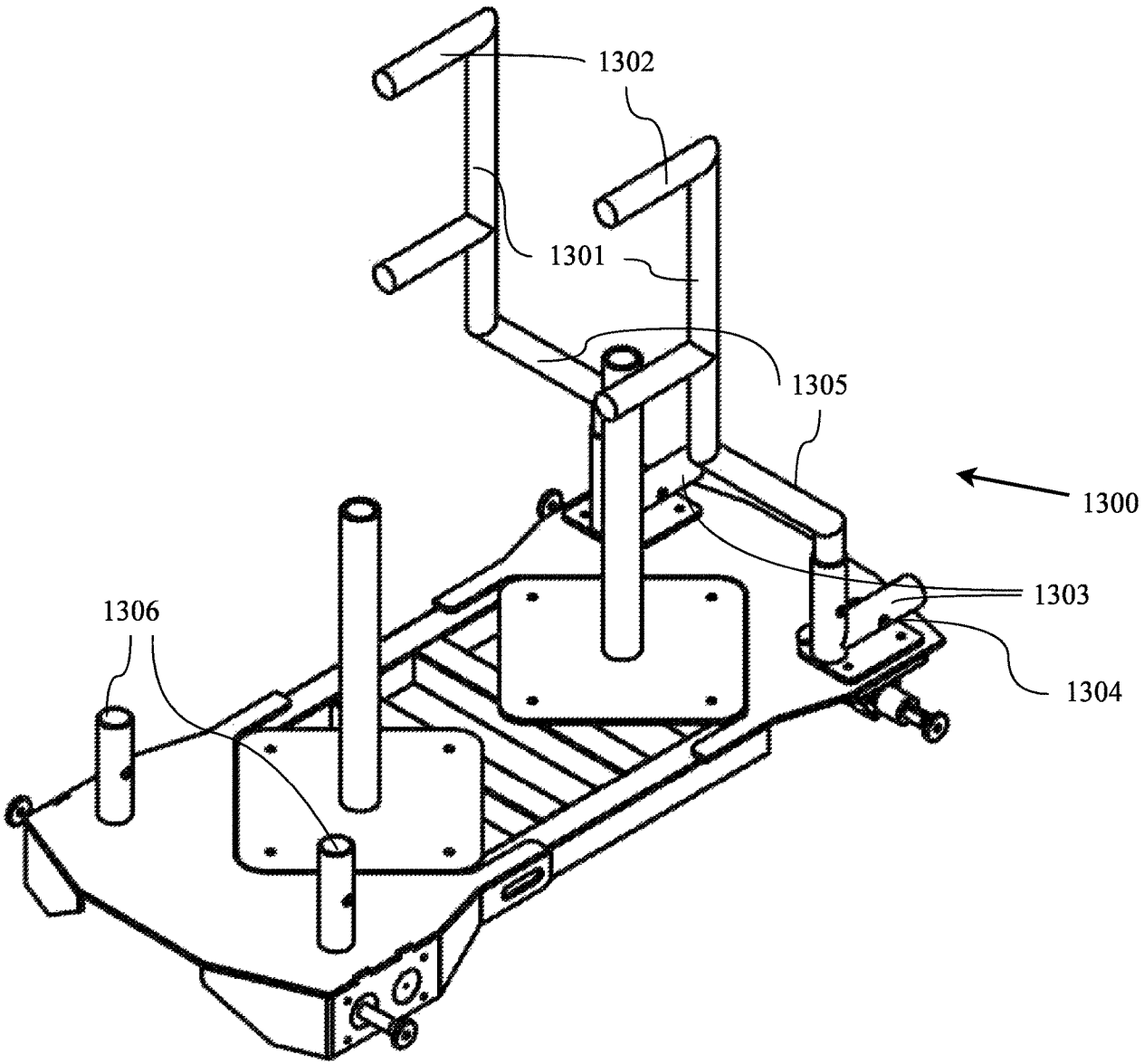
FIG. 13 shows an alternative offset handle arrangement, including a device for adjusting the orientation of the handles from horizontal to vertical.

FIG. 13 shows an alternative forward offset handle arrangement, including a device for adjusting the orientation of the handles from horizontal to vertical. In this arrangement, a pair of handles 1301 is provided each comprising a main shaft 1301 and one or more optional appendages 1302. The handles may be made of any rigid material (e.g., solid metal shafts, metal tubes, plastic tubes or shafts, wood, etc.) and of any cross-sectional shape (e.g., round, square, triangular, etc.). The optional appendages 1302 facilitate gripping of the handles on axes and orientations different from that of the main shaft 1301. In this embodiment, the main shaft 1301 further comprises an angled section 1305 which offsets in a forward direction sections of the main shaft 1301 at the locations where the main shaft 1301 is gripped, allowing the user to place his or her body weight further toward the front of the weight sled, as opposed to entirely behind the weight sled. This forward offset tends to reduce the tendency of the user to push upward, lifting the rear wheels of the weight sled. A connector 1303, 1306 attached to the weight sled allows each of the handles 1301 to be attached to the weight sled. In this embodiment, the connector 1303 is a bi-directional tubular connector into which the end of the main shaft 1301 of each handle 1301 may be inserted to affix the handle to the weight sled. In other embodiments, however, the connector 1303 may be multi-angled, ratcheted, or rotatable with a locking mechanism, such that the handles 1301 can be fixed at varying angles between horizontal and vertical. The main shaft 1301 and the connector 1303 may have aligning sets of holes 1304 through which pins or rods may be inserted to further secure the handles 1301 to the connector 1303, 1306. The main shaft 1301 of each handle 1301 may be inserted either into the horizontal or the vertical portion of the connector, thus changing the position of the handles from a horizontal position (for dead lifting and for wheelbarrow pushing/pulling) to a vertical position (for horizontal pushing/pulling). In this arrangement, the handles 1301 are shown in a vertical position. In the horizontal position, the offset of the handles 1301 would raise the grippable portion of the handles 1301 higher up from the floor, which would be useful for individuals with trouble bending down to lift the weight sled (e.g., those with back or knee problems).

Figure 14:
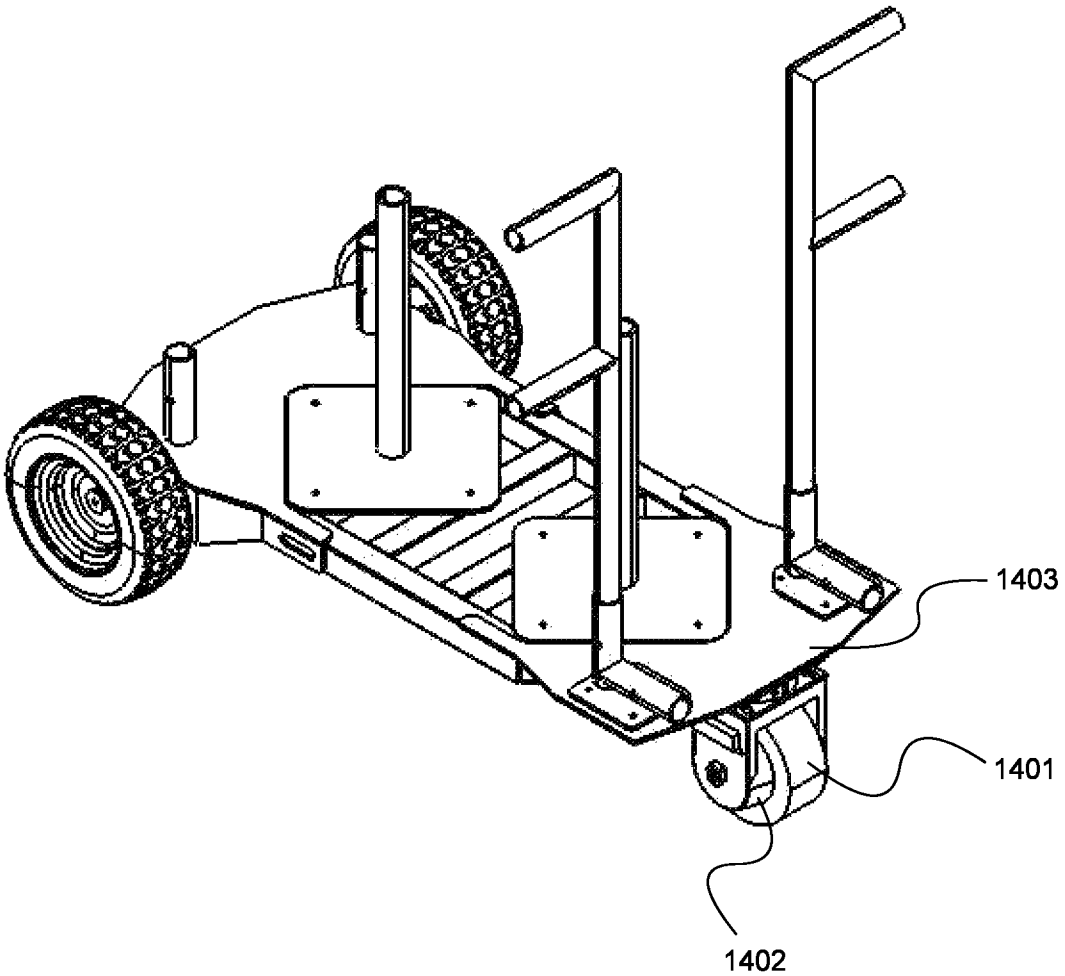
FIG. 14 is an orthogonal view of an alternative motorized caster wheel embodiment of a weight sled.

FIG. 14 is an orthogonal view of an alternative motorized caster wheel embodiment of a weight sled. In this diagram, a caster wheel 1401 comprising a shorted or partially shorted internal motor 1402 is mounted to the back end 1403 of a weight sled. The addition of a motorized caster wheel 1401 expands workout capabilities of the weight sled by allowing for movement in both sagittal and frontal planes simultaneously while providing variable resistance due to the internal motor. In one embodiment the motor is shorted to itself and comes out with the caster wheel 1401 and has no wires that leave the wheel. In an additional embodiment where the internal motor has wires that lead to other electronics such as a microcontroller or battery, the wires may be connected using a quick-disconnect feature such that removing the caster wheel 1401 comprises removing the attachment mechanism and unfastening the quick disconnect.

Additional embodiments may include a caster wheel that has no internal motor or has a motor externally mounted. In some embodiments, the motor may be a powered motor which provide driving force to the caster wheel. Multi-directional movements of the weight sled allow for asymmetrical exercises and greatly increase the use of torso muscles and spinal stabilizers when compared with uni-directional movements.

Figure 15:
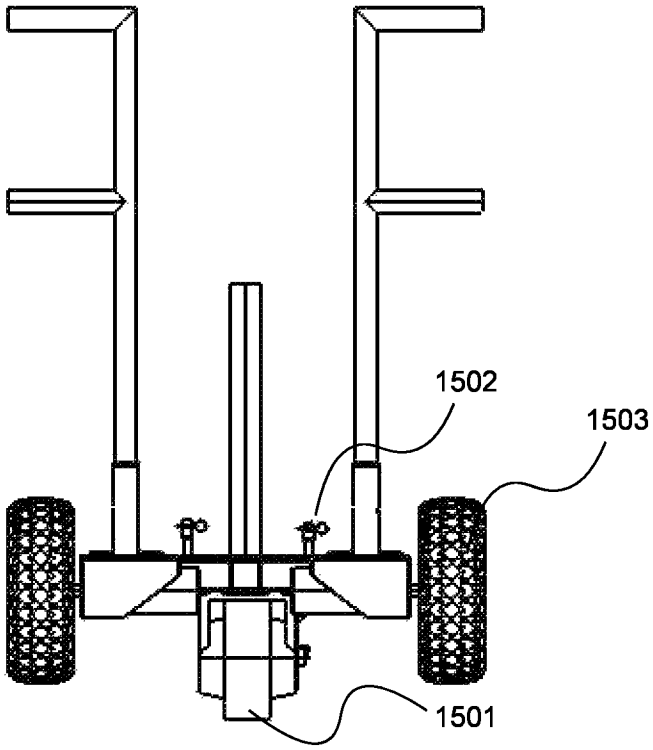
FIG. 15 is a front view of an alternative detachable motorized caster wheel embodiment of a weight sled.

FIG. 15 is a front view of an alternative detachable motorized caster wheel embodiment of a weight sled. In this alternate arrangement of an internal variable-shorted motorized caster wheel 1501, the caster wheel 1501 may be separated from the weight sled by removing a plurality of attachment mechanisms 1502. A few examples of attachment mechanisms 1502 that may be used include screws, bolts, locking pins, cotter pins, hitch pins, or detent pins. In one embodiment the motor is shorted to itself and comes out with the caster wheel 1501 and has no wires that leave the wheel. In an additional embodiment where the internal motor has wires that lead to other electronics such as a microcontroller or battery, the wires may be connected using a quick-disconnect feature such that removing the caster wheel 1501 comprises removing the attachment mechanism and unfastening the quick disconnect.

Removing the caster wheel 1501 allows that (rear) end of the weight sled to rest on the surface while the wheels 1503 on the opposite (front) end act as a pivot point. A user may then perform a plurality of new exercises by lifting the un-wheeled portion of the sled and using the pivot mechanism afforded by removing caster wheel 1501. This feature increases the number of exercises one may perform with the weight sled. In an alternate embodiment, once the caster wheel 1501 has been removed, two matching wheels 1503 may be attached to the weight sled to form the previous arrangement of four wheels (referring to FIG. 1). The matching wheels 1503 may be removed and attached in the same manner as the caster wheel 1501, by utilizing a plurality of attachment mechanisms 1502. Removability also allows wheels with different characteristics to be used (e.g., different sizes, resistances, treads, pneumatic/solid, etc.).

Another useful feature of removable wheels is the ability to store multiple weight sleds in a variety of storage options. One method of storage would be to remove the wheels and handle and stack multiple weight sleds on top of one another. Another example might be to align them vertically in a storage closet or container. This configuration also lends itself to more efficient packaging, shipping, and set up of the weight sled.

Another embodiment of the locking pins 1502 allows a user to lock the axis of rotation of the caster wheel 1501. The locking pins 1502 are inserted into the weight sled such that the locking pin end nearest to the ground physically restricts the angle through which the caster wheel 1501 can rotate. Various mounting positions for the locking pin may be utilized so as to increase or decrease the maximum achievable angle of the caster wheel 1501.

Figure 16:
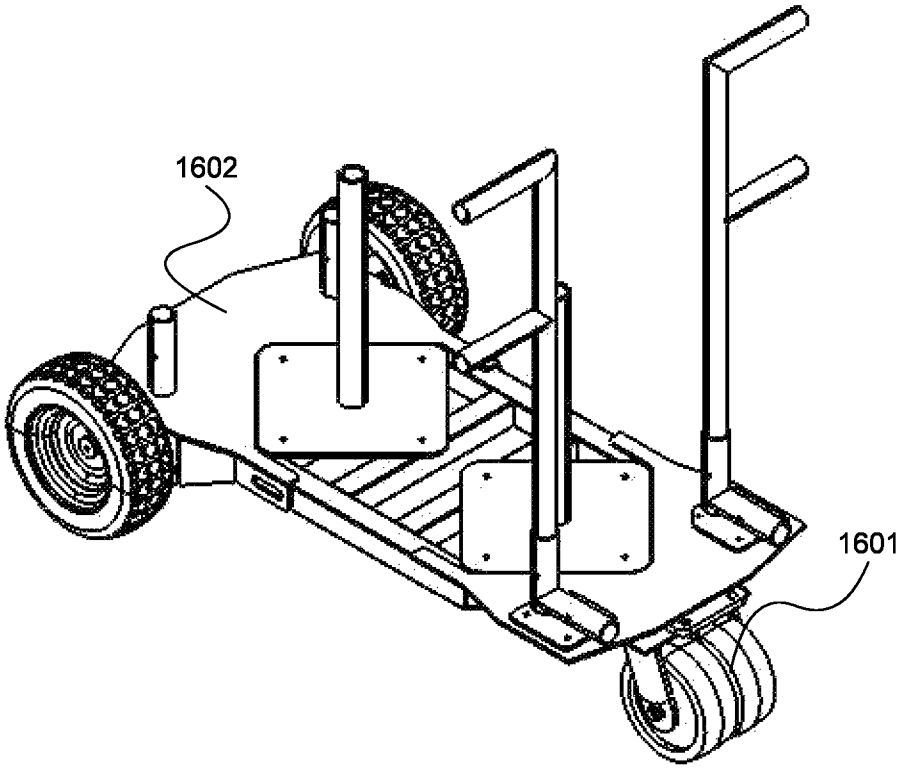
FIG. 16 is an orthogonal view of an alternative twin caster wheel embodiment of a weight sled.

FIG. 16 is an orthogonal view of an alternative twin caster wheel embodiment of a weight sled. In this embodiment, a twin caster wheel 1601 is mounted to the weight sled 1602. Use of the twin caster wheel 1601 allows for a greater load capacity of the weight sled 1602. Further uses include reducing the height of weight sled 1602 by being able to support more weight with smaller diameter wheels. Another useful feature of having twin-caster wheels 1601 is that they require less resistive force while moving compared with a single caster wheel.

Figure 17:
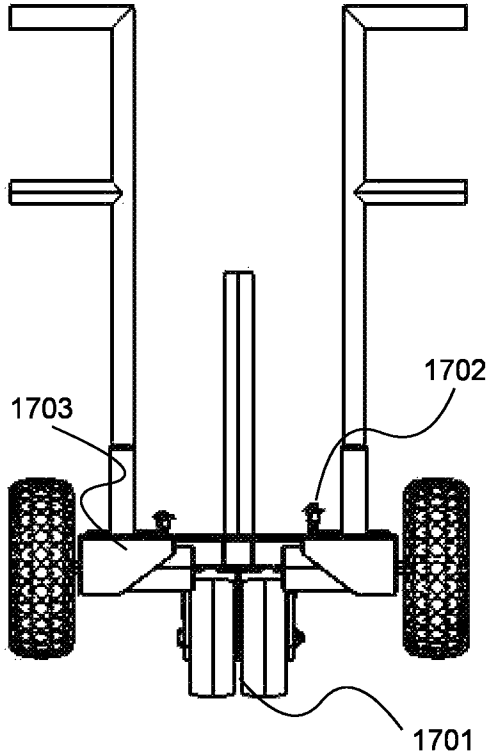
FIG. 17 is a front view of an alternative detachable twin caster wheel embodiment of a weight sled.

FIG. 17 is a front view of an alternative detachable twin caster wheel embodiment of a weight sled. As in FIG. 15, the detachability and rotational lock of the caster wheels 1701 via a plurality of attachment mechanisms 1702 allows for a greater number of configurations of wheels, exercises, and storage options for the weight sled 1703.

Figure 18:
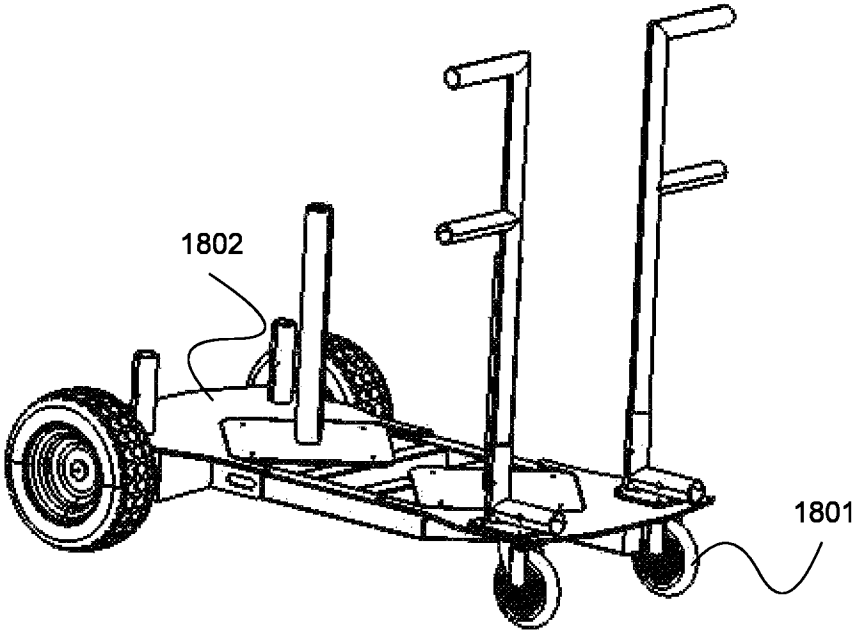
FIG. 18 is an orthogonal view of an alternative embodiment of a weight sled using a corner-mounted set of caster wheels.

FIG. 18 is an orthogonal view of an alternative embodiment of a weight sled using a corner-mounted set of caster wheels. In this arrangement, a caster wheel 1801 is mounted in each back corner of the weight sled 1802. This arrangement may be preferred for greater stability and load bearing capacity as opposed to a single or twin caster wheel mounted to the middle (referring to FIG. 14).

Figure 19:
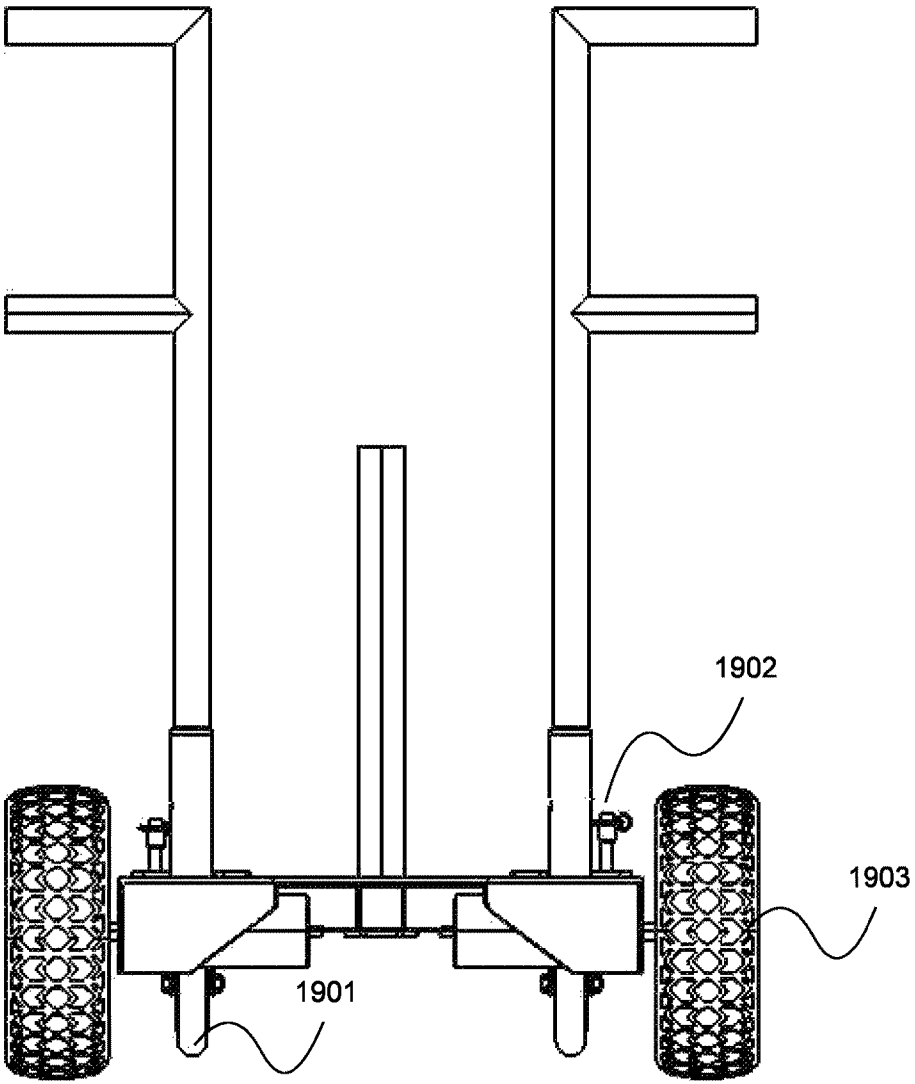
FIG. 19 is a front view of an alternative embodiment of a weight sled using a detachable corner-mounted set of caster wheels.

FIG. 19 is a front view of an alternative embodiment of a weight sled using a detachable corner-mounted set of caster wheels. According to this embodiment, the corner caster wheels 1901 may be replaced with a set of matching (or unmatching) wheels 1903 via a plurality of attachment mechanisms 1902. Refer to FIG. 15 for additional functionality of removable wheels.

Figure 20:
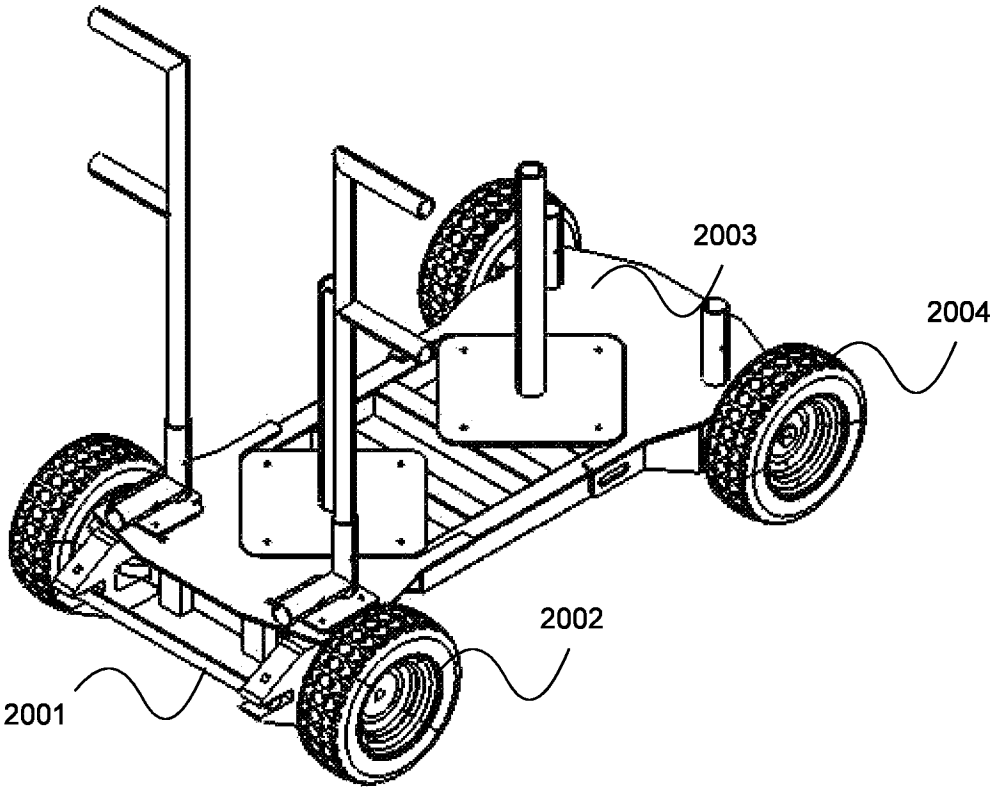
FIG. 20 is an orthogonal view of an alternative four-bar linkage embodiment of a weight sled.

FIG. 20 is an orthogonal view of an alternative four-bar linkage embodiment of a weight sled. In this diagram, a four-bar linkage 2001 comprises four bars connected in a loop by four joints. This allows the back wheels 2002 to be angled away from the front to rear axis of the sled, and allows the user to perform exercise movements in the user's frontal plane. Other variations of four-bar linkages 2001 may be employed such as spherical, spatial, or rocker configurations that allow for independent vertical motion of the wheels 2002. These configurations permit the weight sled to traverse curved or uneven terrain keeping the weight sled body 2003 horizontally level. Other embodiments include four-bar linkages 2001 installed on the front wheels 2004 only or four-bar linkages installed on both the front 2004 and back wheels 2002.

Figure 21:
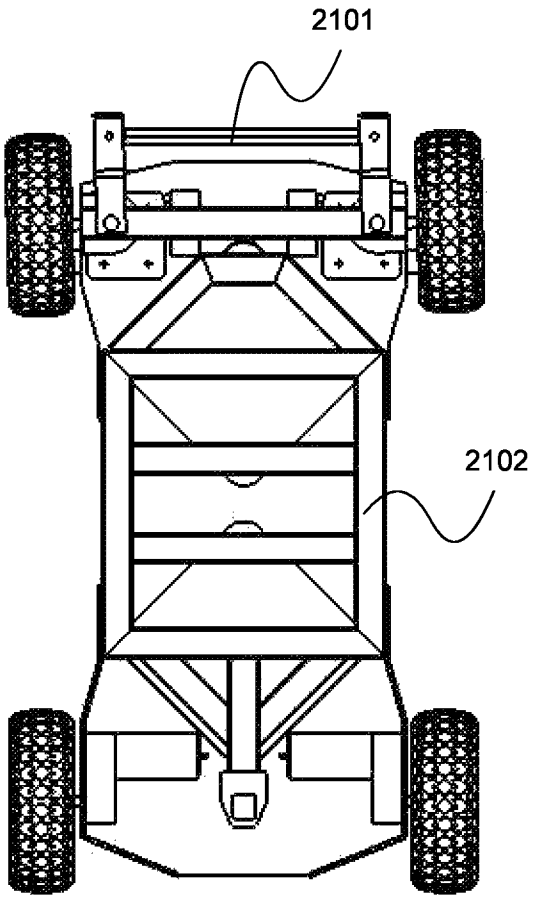
FIG. 21 is a bottom view of the four-bar linkage embodiment of a weight sled.

FIG. 21 is a bottom view of the four-bar linkage embodiment of a weight sled. This diagram illustrates the installation of a four-bar linkage 2101 in the back end of the weight sled 2102 whereby two wheels, either front or back of the sled, are able to shift with one another to turn in a direction, pivoting with each other.

Figure 22:
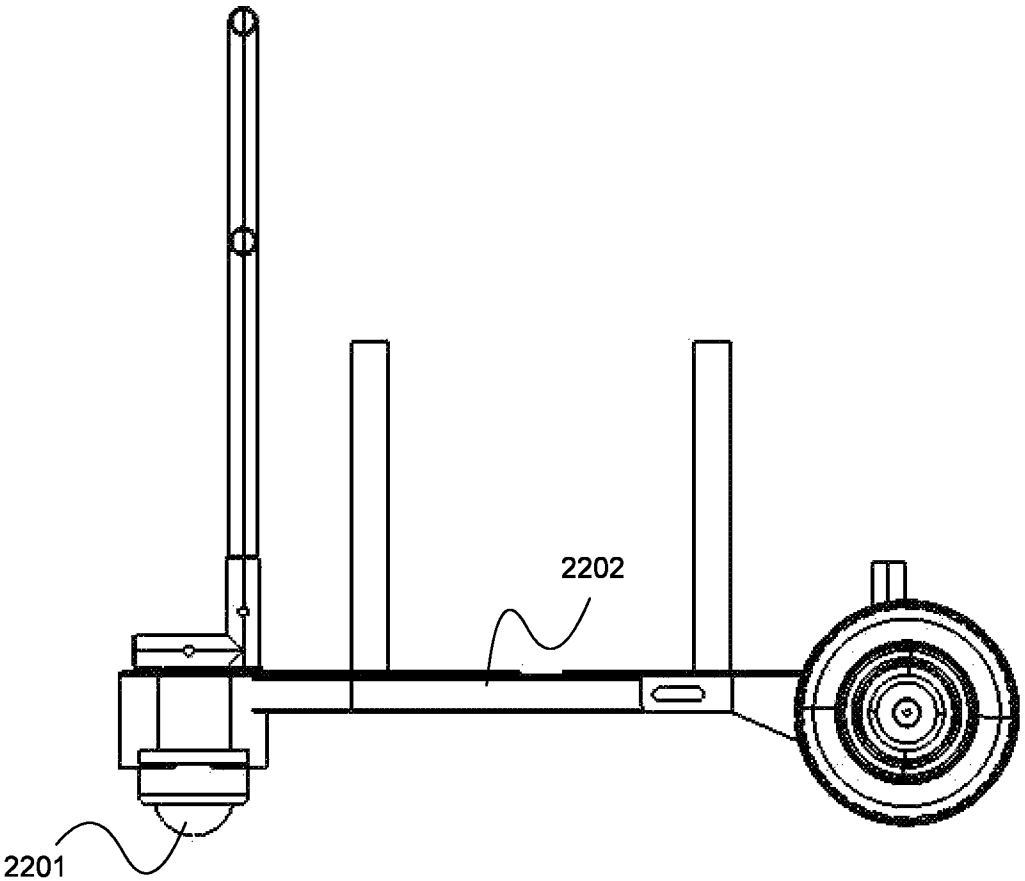
FIG. 22 is a side view of an alternative ball bearing embodiment of a weight sled.

FIG. 22 is a side view of an alternative embodiment which uses a ball bearing caster 2201. A ball bearing caster 2201 can be moved freely in any direction on a two-dimensional surface without the wheel re-orientation of swivel casters and is ideal for weight sled 2202 exercises focused on speed and agility. Additionally, ball bearing casters 2201 may be quieter than traditional caster wheels for applications where noise is a consideration.

Figure 23:
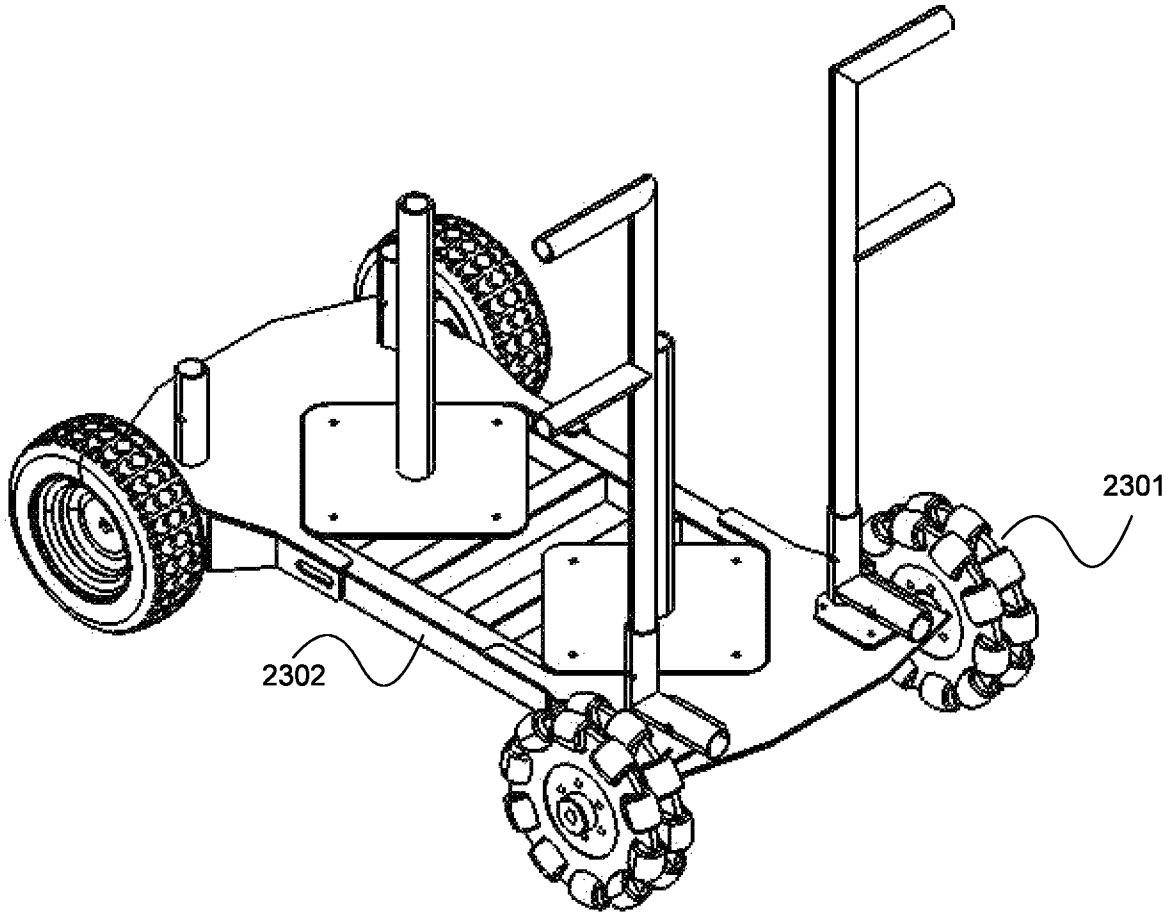
FIG. 23 is an orthogonal view of an alternative omni-wheel embodiment of a weight sled.

FIG. 23 is an orthogonal view of an alternative omni-wheel embodiment of a weight sled. According to this embodiment, omni-directional wheels, also known as omni-wheels may be used. Omni-directional wheels 2301 have smaller rollers 2303 around the circumference of a larger wheel may be used wherein the axles of the smaller rollers 2303 are perpendicular to the axle of the larger wheel. In this embodiment, the omni-directional wheels 2301 are installed in the back end of the weight sled 2302. This allows the back end of the weight sled 2302 to be driven in both the sagittal and frontal directions.

Figure 24:
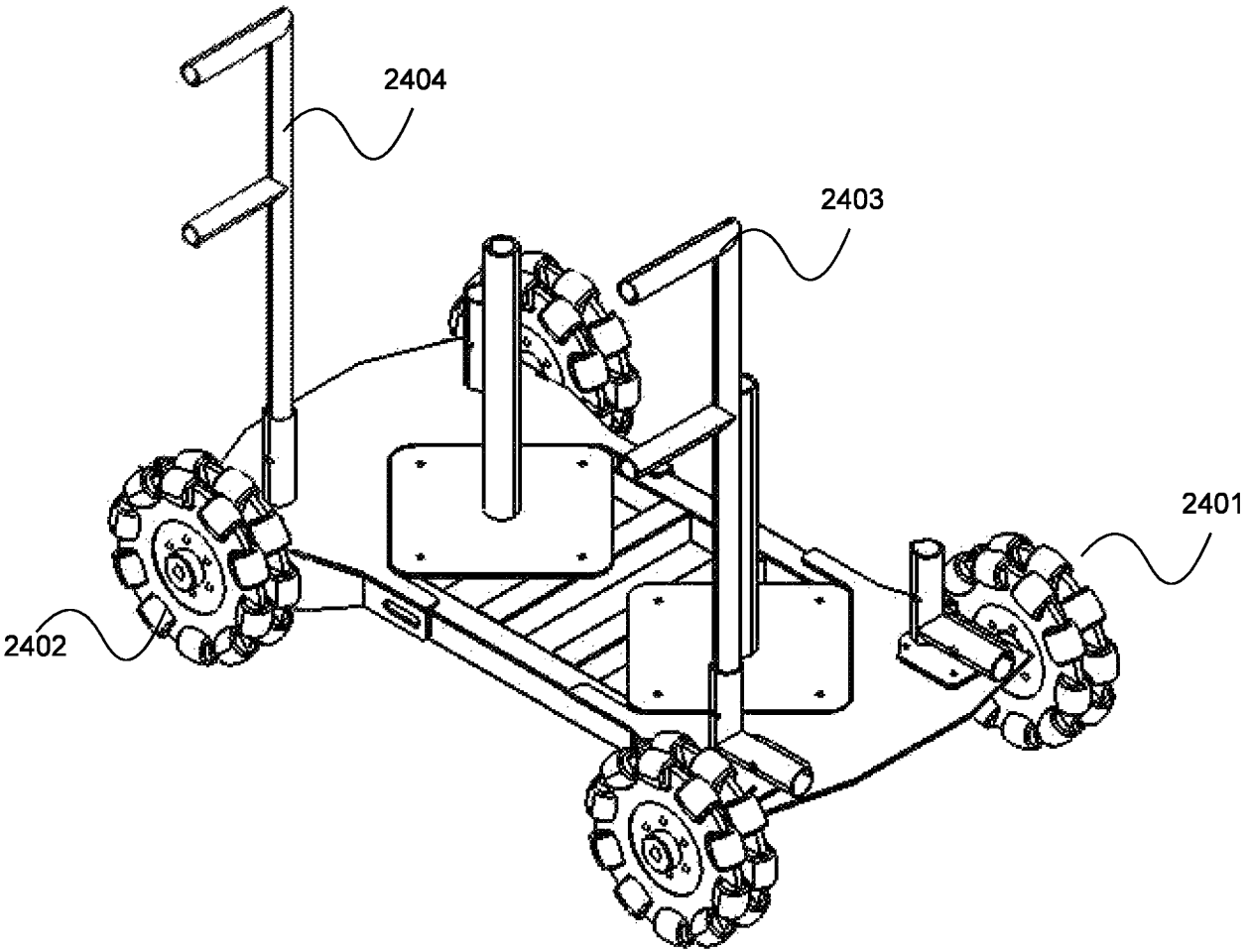
FIG. 24 is an orthogonal view of second alternative omni-wheel embodiment of a weight sled.

FIG. 24 is an orthogonal view of second alternative omni-wheel embodiment of a weight sled. In this arrangement, omni-wheels are installed in both the back 2401 and front 2402 allowing for full lateral motion of the weight sled. This diagram illustrates another technique for using the weight sled with the plurality of wheel configurations already described. This technique involves a user inserting one handle 2403 into a connector in the rear 2401 of the weight sled and another handle 2404 into a connector on the front 2402 of the weight sled transforming the primary direction of travel to the frontal plane. The omni-wheels in this version allow for full sagittal and frontal motion, however other configurations where only one side has a swivel wheel, allows the weight sled to be spun about its non-swivel side. As one example, this arcing motion allows for exercises comprising spinning the sled one hundred and eighty degrees and back again for resistance and cardio workouts.

Figure 25:
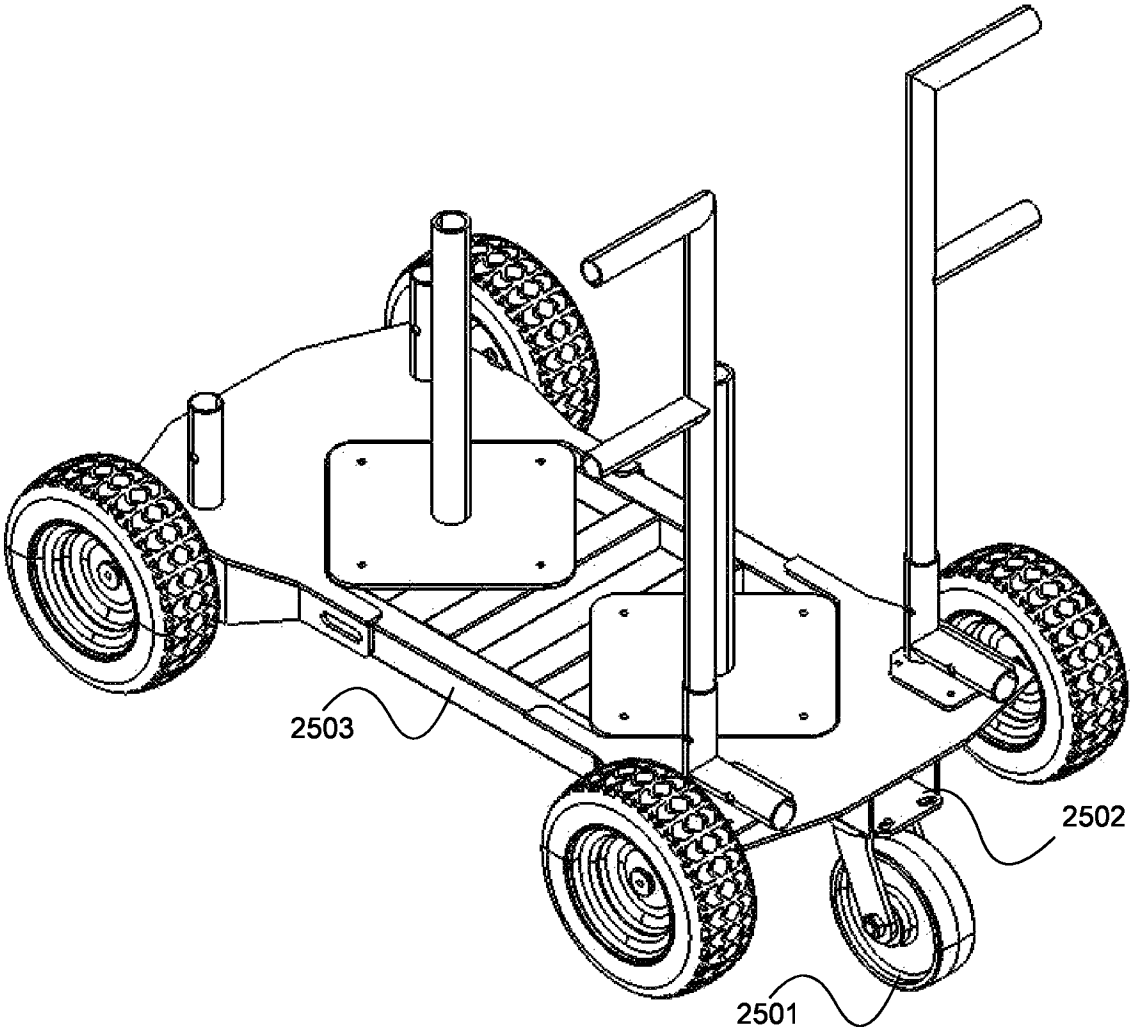
FIG. 25 is an orthogonal view of an alternative detachable slide-mounted caster wheel embodiment of a weight sled.

FIG. 25 is an orthogonal view of an alternative detachable slide-mounted caster wheel embodiment of a weight sled. A caster wheel 2501 (or any previously disclosed embodiments) may be affixed to a housing 2502 permanently attached to the weight sled 2503. The housing 2502 comprises two L-shaped brackets that allow a caster wheel 2501 to slide in and out. An example is the use of a bolt on the housing 2502 that fits into a hole in the caster wheel assembly locking it in place once the caster wheel assembly slides to a specified position. The bolt may be retracted by depressing a tab, turning, or pulling a knob, or removing a locking pin and knocking the bolt out. Any number of slide-locking mechanisms may be used and is not limited to the examples disclosed herein.

As an example of this embodiment, the slide-mounted caster wheel 2501 is positioned closer to the surface than the rear wheels allowing only the caster wheel 2501 to touch the ground and permitting frontal plane movement of the weight sled 2503.

Figure 26:
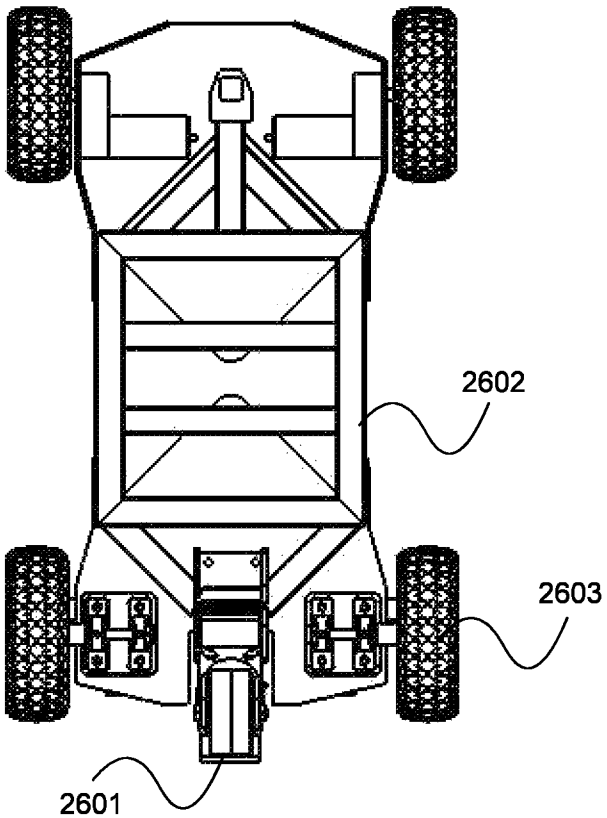
FIG. 26 is a bottom view of an alternative retractable caster wheel embodiment of a weight sled.

FIG. 26 is a bottom view of an alternative retractable caster wheel embodiment of a weight sled. In this diagram, a retractable caster wheel 2601 is affixed to the back end of the weight sled 2602. The retractable caster wheel 2601 comprises a lift pedal (shown in FIG. 27) that is typically activated by a person's foot either lowering or raising the caster wheel 2601. As an example of this embodiment, the retractable caster wheel 2601 is extended to a position closer to the surface than the rear wheels 2603 allowing only the caster wheel 2601 to touch the ground and permitting frontal plane movement of the weight sled 2602. Retracting wheels benefit from the same features described in FIG. 15 regarding detachability and rotation locking.

Figure 27:
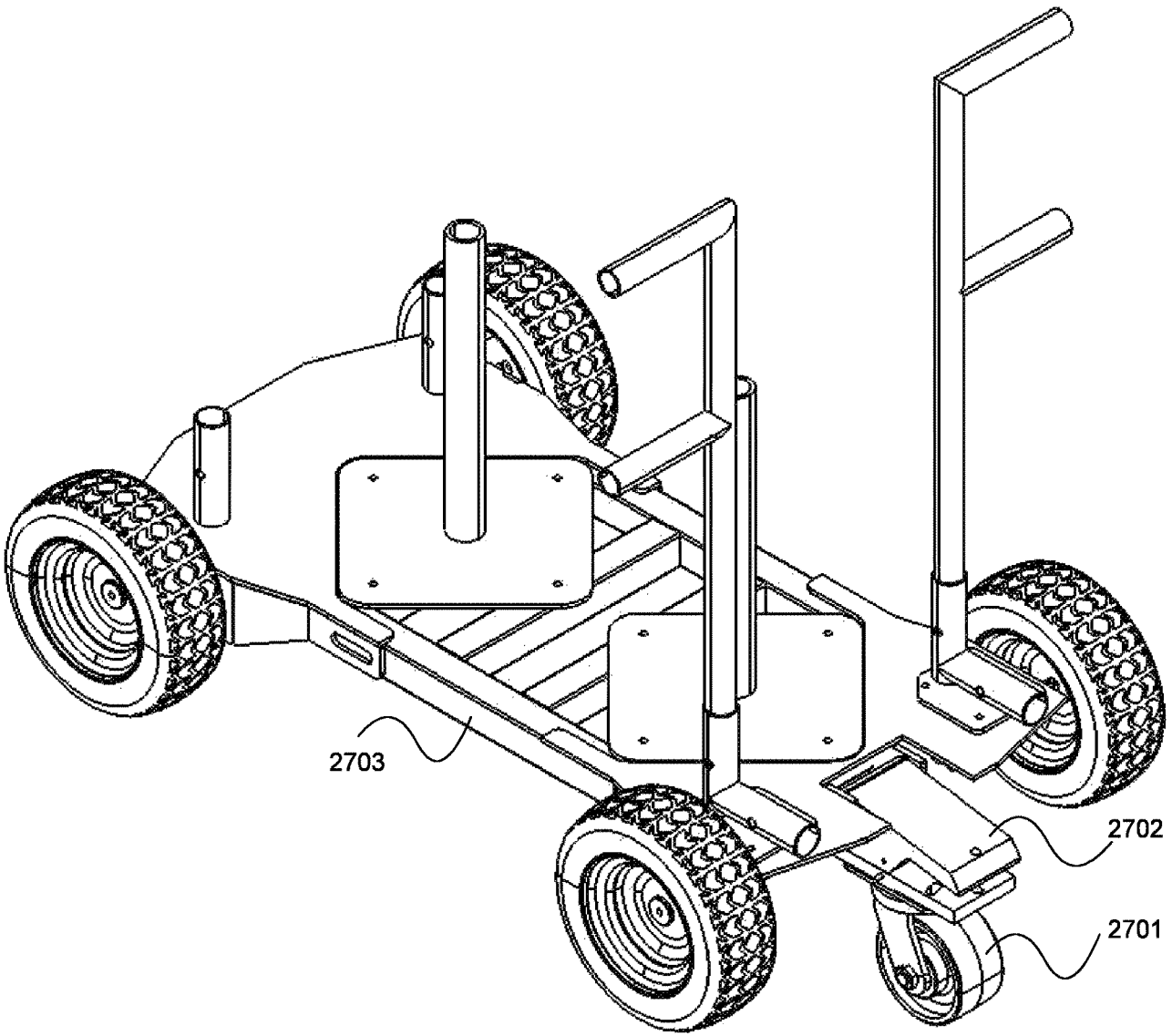
FIG. 27 is an orthogonal view of a second alternative retractable caster wheel embodiment of a weight sled.
Figure 33:
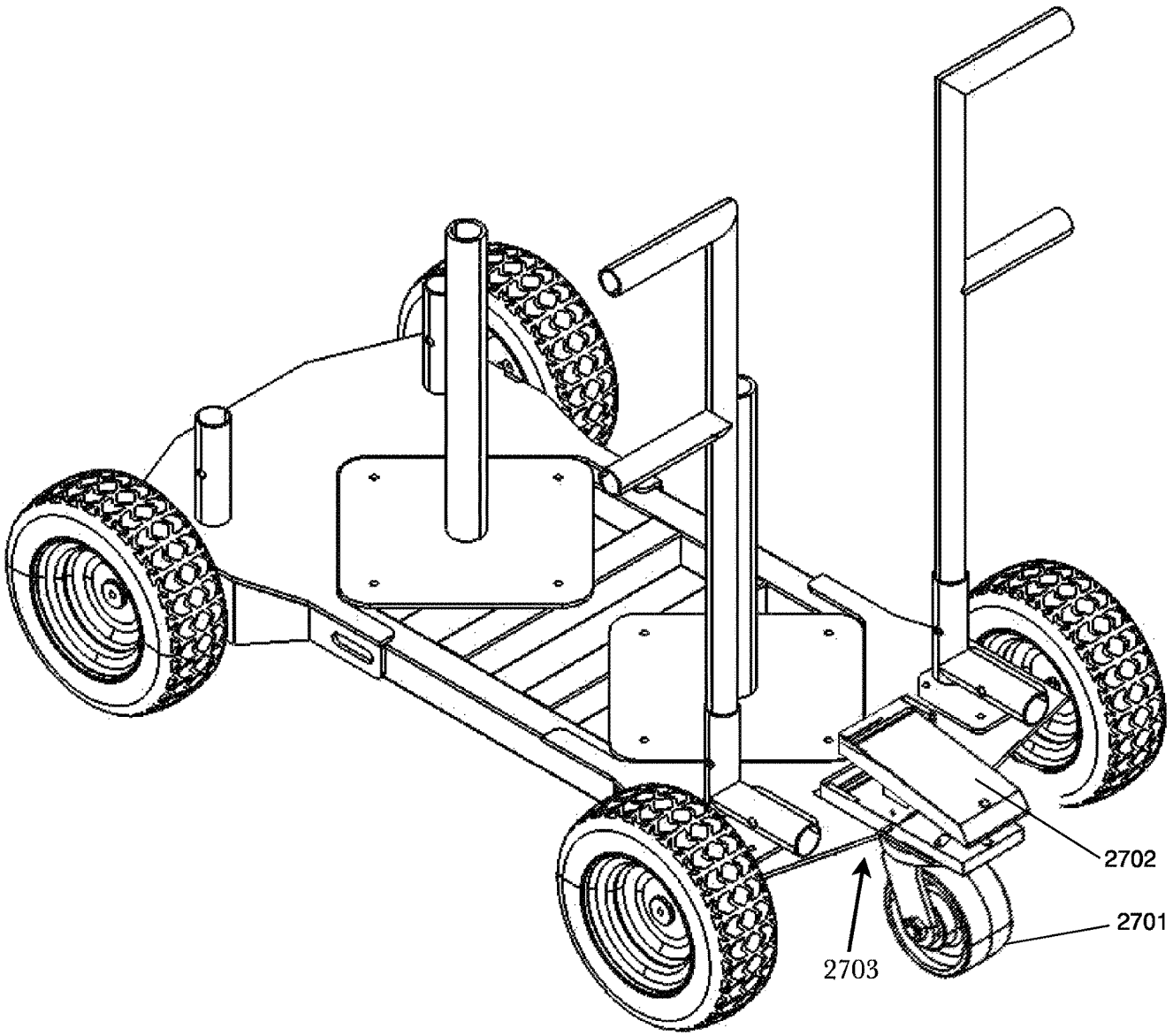
FIG. 33 is an orthogonal view of the embodiment of FIG. 27 showing the caster wheel in a retracted position.

FIG. 27 is an orthogonal view of a second alternative retractable caster wheel embodiment of a weight sled. In this arrangement, the lift pedal 2702 may be activated to change the incline of the weight sled 2703 or to lift the caster wheel 2701 up such that the back end of the weight sled 2703 rests on the surface of the ground or on a set of rear wheels, as shown in FIG. 26, thus converting the weight sled into a standard weight sled with linear only motion. FIG. 33 is an orthogonal view of the same embodiment showing the caster wheel 2701 in a retracted position 2703 after depression of the lift pedal 2702.

Figure 28:
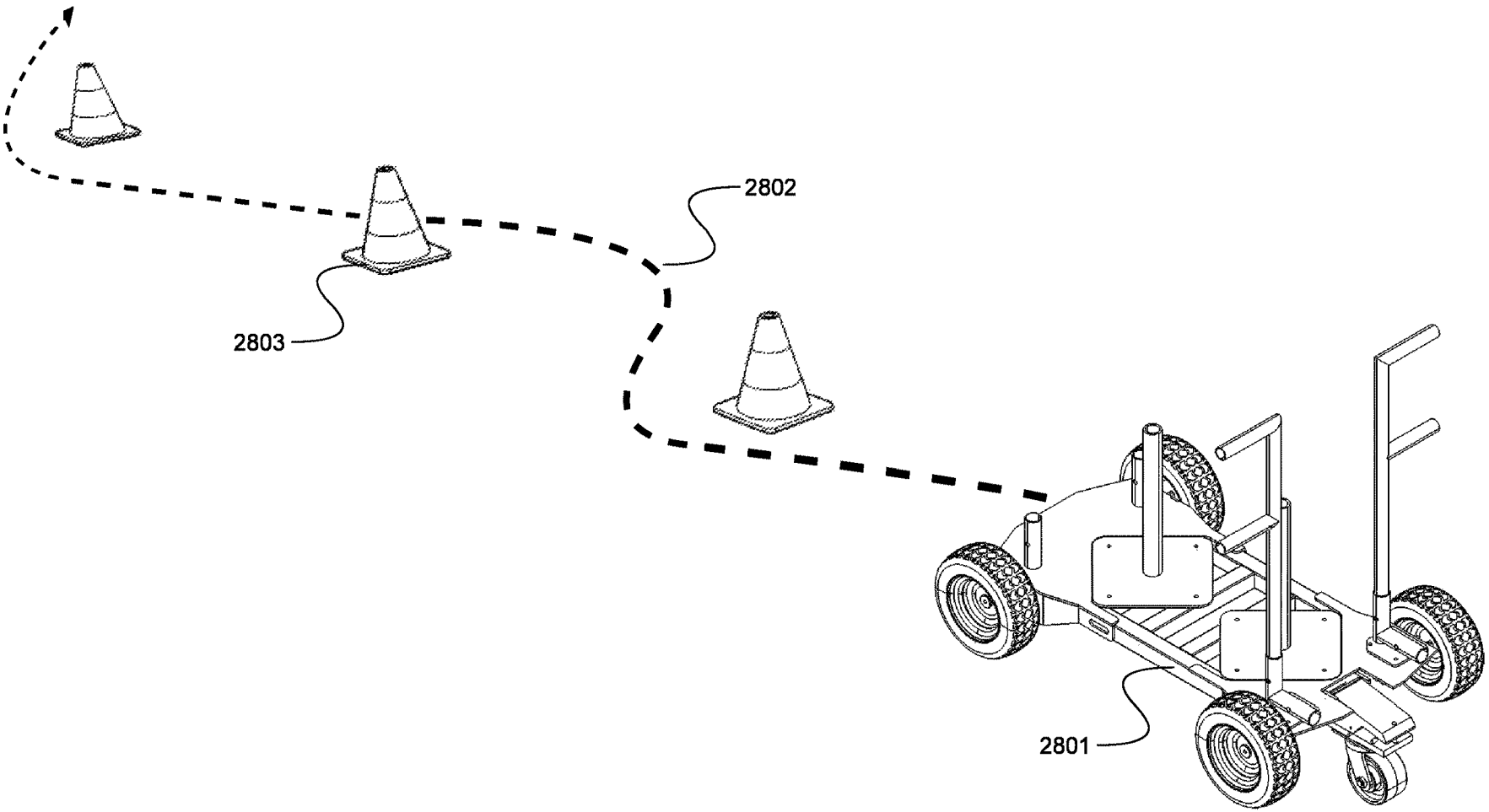
FIG. 28 is an orthogonal view of a retractable caster wheel embodiment of a weight sled completing sagittal and frontal movements around a slalom training exercise.

FIG. 28 is an orthogonal view of a retractable caster wheel embodiment of a weight sled completing sagittal and frontal movements around a slalom training exercise. In this diagram, a weight sled 2801 comprising a retractable caster wheel follows a multi-directional path 2802 around a series of cones 2803. This is not possible with current state-of-the-art weight sleds and is achieved by enabling omni-directional travel via the swivel action of the caster wheel. This is one example of the many possible new exercises that may be derived from the plurality of wheel configurations described herein.

Hardware Architecture

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit (ASIC), or on a network interface card.

Software/hardware hybrid implementations of at least some of the aspects disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific aspects, at least some of the features or functionalities of the various aspects disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some aspects, at least some of the features or functionalities of the various aspects disclosed herein may be implemented in one or more virtualized computing environments (e.g., network computing clouds, virtual machines hosted on one or more physical computing machines, or other appropriate virtual environments).

Figure 29:
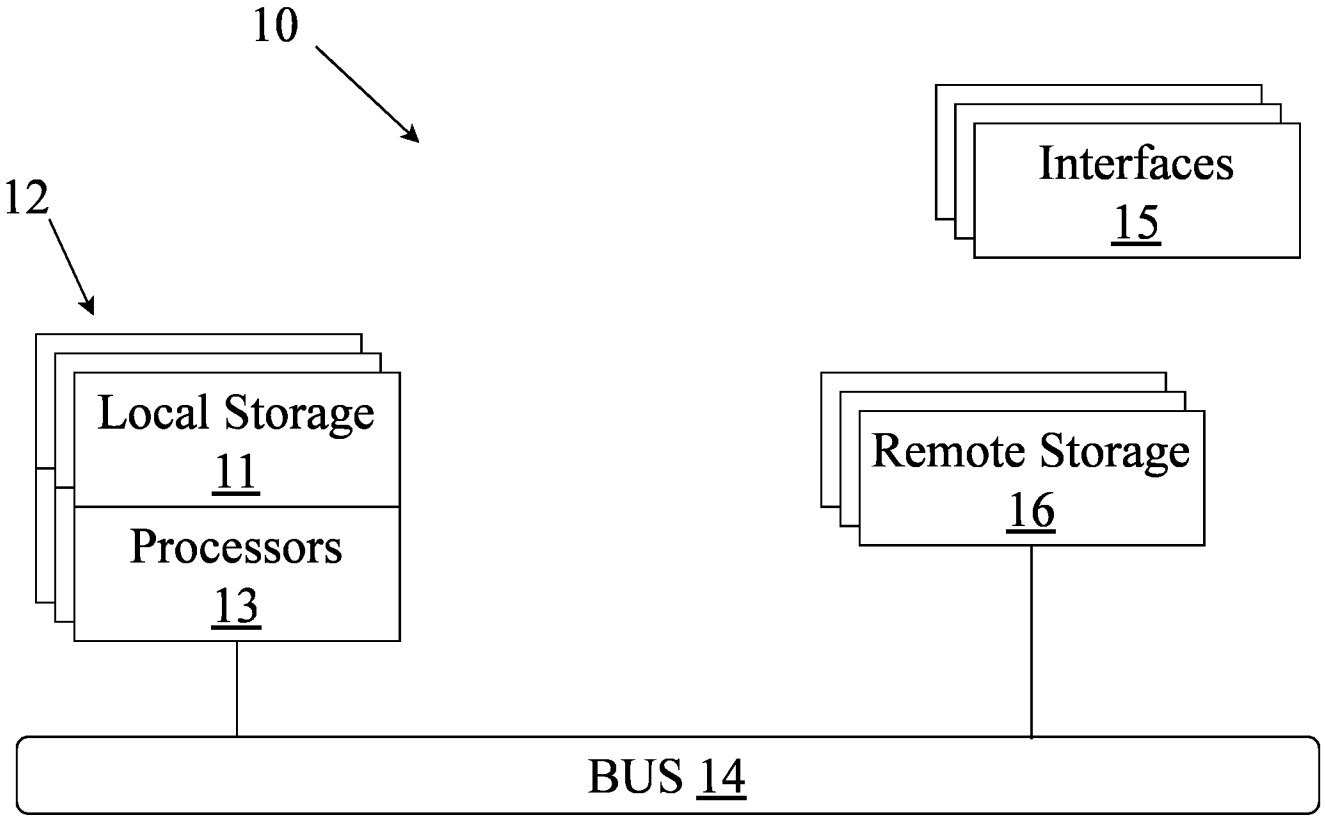
FIG. 29 is a block diagram illustrating an exemplary hardware architecture of a computing device.

Referring now to FIG. 29, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one aspect, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one aspect, a computing device 10 may be configured or designed to function as a server system utilizing CPU 12, local memory 11 and/or remote memory 15, and interface(s) 16. In at least one aspect, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some aspects, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a particular aspect, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one aspect, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity AN hardware interfaces) and, in some instances, volatile and/or non-volatile memory (e.g., RAM).

Although the system shown in FIG. 29 illustrates one specific architecture for a computing device 10 for implementing one or more of the aspects described herein, it is by no means the only device architecture on which at least a portion of the features and techniques described herein may be implemented. For example, architectures having one or any number of processors 13 may be used, and such processors 13 may be present in a single device or distributed among any number of devices. In one aspect, a single processor 13 handles communications as well as routing computations, while in other aspects a separate dedicated communications processor may be provided. In various aspects, different types of features or functionalities may be implemented in a system according to the aspect that includes a client device (such as a tablet device or smartphone running client software) and server systems (such as a server system described in more detail below).

Regardless of network device configuration, the system of an aspect may employ one or more memories or memory modules (such as, for example, remote memory block 16 and local memory 11) configured to store data, program instructions for the general-purpose network operations, or other information relating to the functionality of the aspects described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein.

Because such information and program instructions may be employed to implement one or more systems or methods described herein, at least some network device aspects may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

Figure 30:
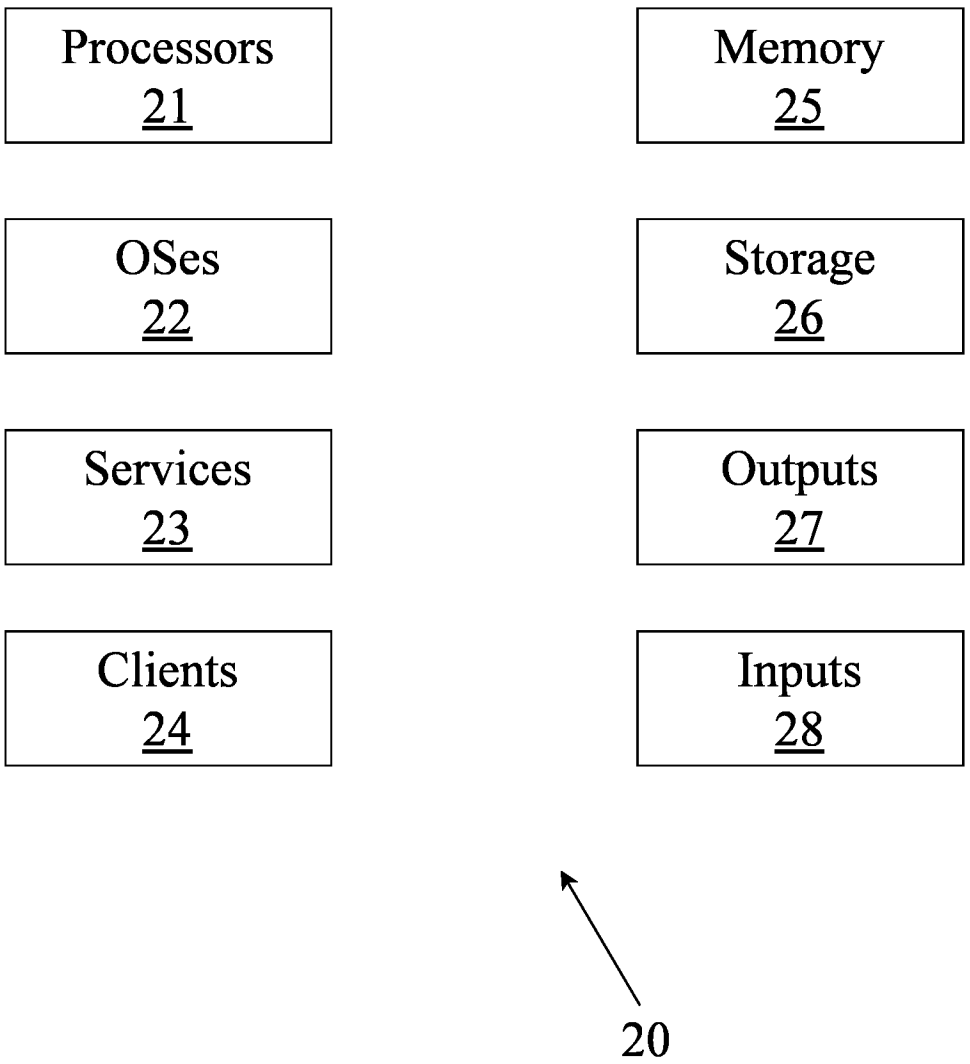
FIG. 30 is a block diagram illustrating an exemplary logical architecture for a client device.

In some aspects, systems may be implemented on a standalone computing system. Referring now to FIG. 30, there is shown a block diagram depicting a typical exemplary architecture of one or more aspects or components thereof on a standalone 5 computing system. Computing device 20 includes processors 21 that may run software that carry out one or more functions or applications of aspects, such as for example a client application 24. Processors 21 may carry out computing instructions under control of an operating system 22 such as, for example, a version of MICROSOFT WINDOWS™ operating system, APPLE macOS™ or iOS™ operating systems, some variety of the Linux operating system, ANDROID™ operating system, or the like. In many cases, one or more shared services 23 may be operable in computing device 20, and may be useful for providing common services to client applications 24. Services 23 may for example be WINDOWS™ services, user-space common services in a Linux environment, or any other type of common service architecture used with operating system 22. Input devices 28 may 15 be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to computing device 20, and may include for example one or more screens for visual output, speakers, printers, or any combination thereof. Memory 25 may be random access memory having any structure and architecture known in the art, for use by processors 21, for example to run software. Storage devices 26 may be any magnetic, optical, mechanical, memristor, or electrical storage device for storage of data in digital form (such as those described above, referring to FIG. 29). Examples of storage devices 26 include flash memory, magnetic hard drive, CD-ROM, and/or the like.

Figure 31:
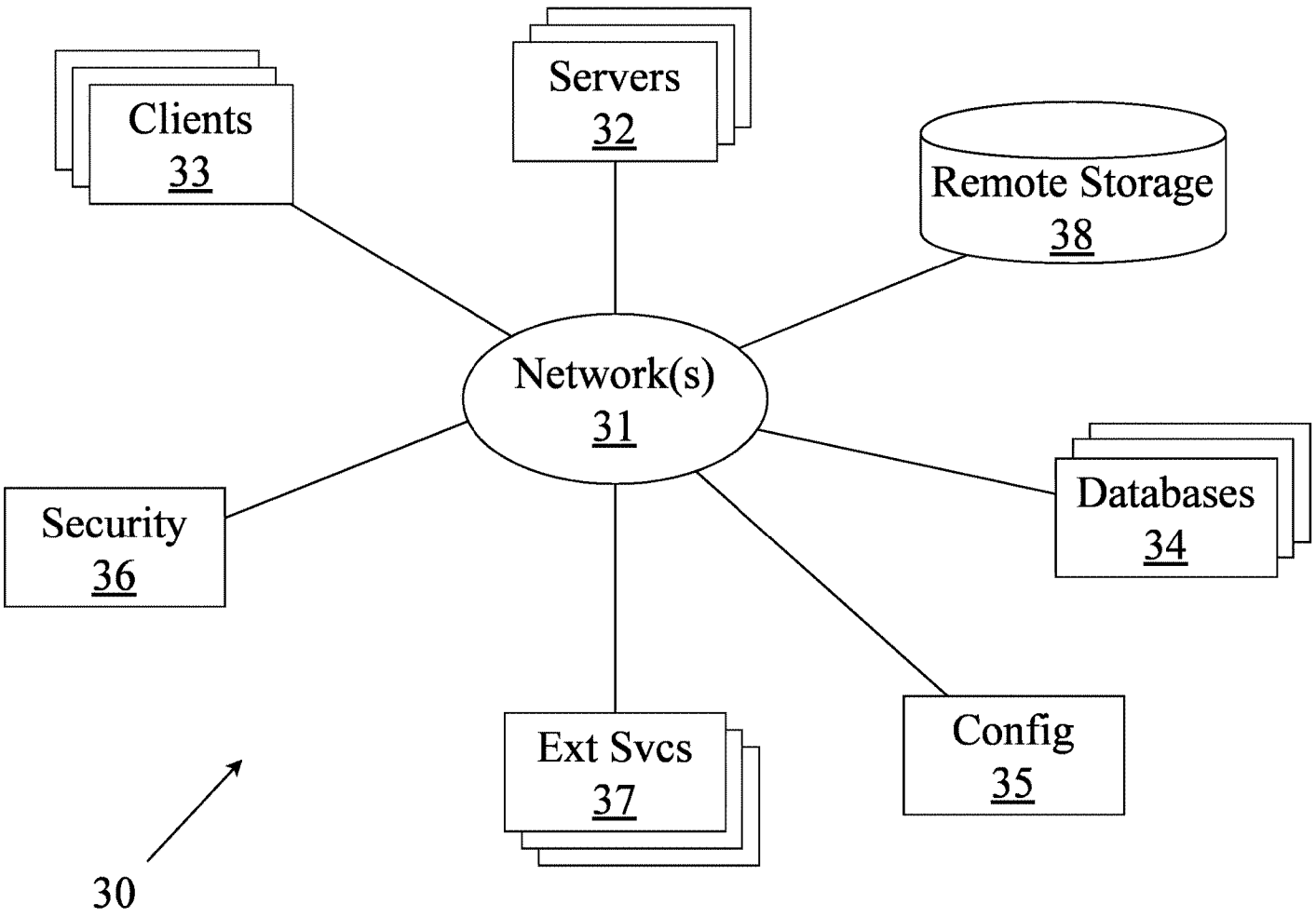
FIG. 31 is a block diagram showing an exemplary architectural arrangement of clients, servers, and external services.

In some aspects, systems may be implemented on a distributed computing network, such as one having any number of clients and/or servers. Referring now to FIG. 31, there is shown a block diagram depicting an exemplary architecture 30 for implementing at least a portion of a system according to one aspect on a distributed computing network. According to the aspect, 41 any number of clients 33 may be provided. Each client 33 may run software for implementing client-side portions of a system; clients may comprise a computing device 20 such as that illustrated in FIG. 30. In addition, any number of servers 32 may be provided for handling requests received from one or more clients 33. Clients 33 and servers 32 may communicate with one another via one or more electronic networks 31, which may be in various aspects any of the Internet, 5 a wide area network, a mobile telephony network (such as CDMA or GSM cellular networks), a wireless network (such as WiFi, WiMAX, LTE, and so forth), or a local area network (or indeed any network topology known in the art; the aspect does not prefer any one network topology over any other). Networks 31 may be implemented using any known network protocols, including for example wired and/or wireless protocols.

In addition, in some aspects, servers 32 may call external services 37 when needed to obtain additional information, or to refer to additional data concerning a particular call. Communications with external services 37 may take place, for example, via one or more networks 31. In various aspects, external services 37 may comprise web-enabled services or functionality related to or installed on the hardware device itself. For example, in one aspect where client applications 24 are implemented on a smartphone or other electronic device, client applications 24 may obtain information stored in a server system 32 in the cloud or on an external service 37 deployed on one or more of a particular enterprise's or user's premises. In addition to local storage on servers 32, remote storage 38 may be accessible through the network(s) 31.

In some aspects, clients 33 or servers 32 (or both) may make use of one or more specialized services or appliances that may be deployed locally or remotely across one or more networks 31. For example, one or more databases 34 in either local or remote storage 38 may be used or referred to by one or more aspects. It should be understood by one having ordinary skill in the art that databases in storage 34 may be arranged in a wide variety of architectures and using a wide variety of data access and manipulation means. For example, in various aspects one or more databases in storage 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some aspects, variant database architectures such as column-oriented databases, in-memory databases, clustered databases, distributed databases, or even flat file data repositories may be used according to the aspect. It will be appreciated by one having ordinary skill in the art that any combination of known or future database technologies may be used as appropriate, unless a specific database technology or a specific arrangement of components is specified for a particular aspect described herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, some aspects may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with aspects without limitation, unless a specific security 36 or configuration system 35 or approach is specifically required by the description of any specific aspect.

Figure 32:
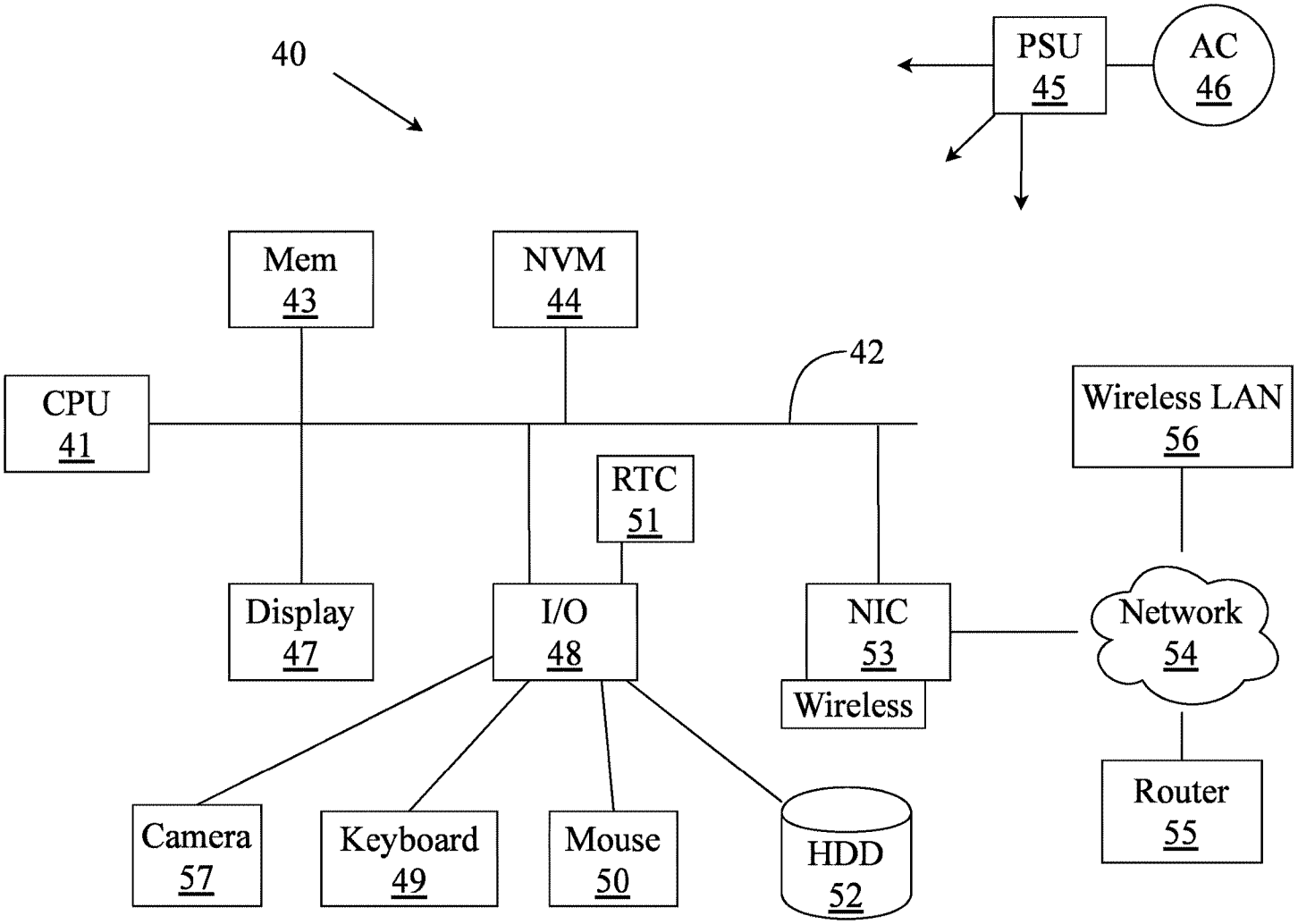
FIG. 32 is another block diagram illustrating an exemplary hardware architecture of a computing device.

FIG. 32 shows an exemplary overview of a computer system 40 as may be used in any of the various locations throughout the system. It is exemplary of any computer that may execute code to process data. Various modifications and changes may be made to computer system 40 without departing from the broader scope of the system and method disclosed herein. Central processor unit (CPU) 41 is connected to bus 42, to which bus is also connected memory 43, nonvolatile memory 44, display 47, input/output (I/O) unit 48, and network interface card (NIC) 53. I/O unit 48 may, typically, be connected to peripherals such as a keyboard 49, pointing device 50, hard disk 52, real-time clock 51, a camera 57, and other peripheral devices. NIC 53 connects to network 54, which may be the Internet or a local network, which local network may or may not have connections to the Internet. The system may be connected to other computing devices through the network via a router 55, wireless local area network 56, or any other network connection. Also shown as part of system 40 is power supply unit 45 connected, in this example, to a main alternating current (AC) supply 46. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In various aspects, functionality for implementing systems or methods of various aspects may be distributed among any number of client and/or server components. For example, various software modules may be implemented for performing various functions in connection with the system of any particular aspect, and such modules may be variously implemented to run on server and/or client components.

The skilled person will be aware of a range of possible modifications of the various aspects described above. Accordingly, the present invention is defined by the claims and their equivalents.

What is claimed is:

1. An omni-directional weight sled, comprising:

a chassis constructed of rigid materials;

a plurality of electromagnetic resistance mechanisms, wherein the resistance of each electromagnetic resistance mechanism is controllable by adjusting an electrical connection across the leads of the electromagnetic resistance mechanism using a controller; and a plurality of wheels attached to the chassis, wherein:

at least one of the plurality of wheels is capable of swiveling or pivoting;

a first wheel of the plurality of wheels is attached to a first electromagnetic resistance mechanism of the plurality of electromagnetic resistance mechanisms; and a second wheel of the plurality of wheels is attached to a second electromagnetic resistance mechanism of the plurality of electromagnetic resistance mechanisms; and the controller comprising a memory, a processor, and a plurality of programming instructions stored in the memory which, when operating on the processor, causes the controller to adjust the electrical connection of each of the plurality of electromagnetic resistance mechanisms.

2. The weight sled of claim 1, wherein at least one of the plurality of wheels capable of swiveling or pivoting is a caster wheel.

3. The weight sled of claim 2, wherein one of the plurality of electromagnetic resistance mechanisms is attached to the caster wheel.

4. The weight sled of claim 3, wherein the electromagnetic resistance mechanism attached to the caster wheel is a permanent magnet electric motor that is fully or partially shorted to provide a variable resistance.

5. The weight sled of claim 3, wherein the electromagnetic resistance mechanism attached to the caster wheel is electromagnetic eddy current brake that is fully or partially shorted to provide a variable resistance.

6. The weight sled of claim 1, wherein at least one of the plurality of wheels capable of swiveling or pivoting is retractable.

7. The weight sled of claim 6, wherein the at least one of the plurality of wheels capable of swiveling or pivoting is affixed by a locking pin mechanism.

8. The weight sled of claim 6, wherein the at least one of the plurality of wheels capable of swiveling or pivoting is retractable by a foot pedal mechanism.

9. The weight sled of claim 1, comprising at least two wheels capable of swiveling or pivoting, and wherein the at least two wheels capable of swiveling or pivoting are connected via a four-bar linkage.

10. The weight sled of claim 1, wherein at least one of the plurality of wheels is not capable of swiveling or pivoting, and at least one of the electromagnetic resistance mechanisms is mechanically connected to the at least one of the plurality of wheels not capable of swiveling or pivoting.

11. An omni-directional weight sled, comprising:

a chassis constructed of rigid materials; and a plurality of electromagnetic resistance mechanisms, wherein the resistance of each electromagnetic resistance mechanism is controllable by adjusting an electrical connection across the leads of the electromagnetic resistance mechanism using a controller; and a plurality of wheels attached to the chassis, wherein:

at least one of the plurality of wheels is an omni-directional wheel;

a first wheel of the plurality of wheels is attached to a first electromagnetic resistance mechanism of the plurality of electromagnetic resistance mechanisms; and a second wheel of the plurality of wheels is attached to a second electromagnetic resistance mechanism of the plurality of electromagnetic resistance mechanisms; and the controller comprising a memory, a processor, and a plurality of programming instructions stored in the memory which, when operating on the processor, causes the controller to adjust the electrical connection of each of the plurality of electromagnetic resistance mechanisms.

12. The weight sled of claim 11 wherein the omni-directional wheel is an omni-wheel, comprising rollers mounted around the circumference of a wheel, the axles of the rollers being perpendicular to the axle of the wheel.

13. The weight sled of claim 11 wherein the omni-directional wheel is a ball bearing caster.

14. The weight sled of claim 11, wherein the omni-directional wheel is retractable.

15. The weight sled of claim 11, wherein the omni-directional wheel is affixed by a locking pin mechanism.

16. The weight sled of claim 11, wherein the omni-directional wheel is retracted by a foot pedal mechanism.

17. The weight sled of claim 11, wherein at least one of the plurality of wheels is not an omni-directional wheel, and at least one of the electromagnetic resistance mechanisms is mechanically connected to the at least one of the plurality of wheels that is not an omni-directional wheel.

* * * * *